United States Patent [19]

Nishiguchi et al.

[11] Patent Number: 4,965,155

[45] Date of Patent: Oct. 23, 1990

[54] ORGANIC PHOTOCONDUCTIVE MATERIAL FOR ELECTROPHOTOGRAPHY

[75] Inventors: Toshihiko Nishiguchi; Mika Yamamura, both of Osaka, Japan

[73] Assignee: Mita Industrial Co., Ltd., Osaka, Japan

[21] Appl. No.: 279,083

[22] Filed: Dec. 2, 1988

[30] Foreign Application Priority Data

| | | | |
|---|---|---|---|
| Dec. 3, 1987 | [JP] | Japan | 62-308178 |
| Dec. 17, 1987 | [JP] | Japan | 62-321033 |
| Dec. 17, 1987 | [JP] | Japan | 62-321034 |
| Dec. 18, 1987 | [JP] | Japan | 62-322308 |
| Dec. 18, 1987 | [JP] | Japan | 62-322309 |
| Dec. 28, 1987 | [JP] | Japan | 62-333451 |
| Dec. 28, 1987 | [JP] | Japan | 62-333452 |
| Dec. 28, 1987 | [JP] | Japan | 62-333453 |
| Dec. 28, 1987 | [JP] | Japan | 62-333454 |
| Dec. 28, 1987 | [JP] | Japan | 62-333455 |

[51] Int. Cl.[5] ..... G03G 5/07

[52] U.S. Cl. ..... 430/58; 430/77; 430/106; 430/69

[58] Field of Search ..... 430/77, 283, 58

[56] References Cited

U.S. PATENT DOCUMENTS

| | | | |
|---|---|---|---|
| 3,912,507 | 10/1975 | Keller et al. | 430/77 |
| 3,961,952 | 6/1976 | Sprague | 430/77 |
| 4,885,369 | 12/1989 | Uryu et al. | 430/77 |

FOREIGN PATENT DOCUMENTS

| | | | |
|---|---|---|---|
| 4843145 | 12/1973 | Japan | 430/77 |
| 57201236 | 12/1982 | Japan | 430/77 |

*Primary Examiner*—Marion C. McCamish
*Assistant Examiner*—Christopher D. Rodee
*Attorney, Agent, or Firm*—Sherman & Shalloway

[57] ABSTRACT

Disclosed is an organic photoconductive material for the electrophotography, which comprises a linear high-molecular-weight polymer having a rhodanine derivative of the following formula incorporated as a substituent:

In this derivative group, a benzylidene group or the like is bonded to the 5-position of the rhodanine ring. A photosensitive material comprising a polymer having this rhodanine derivative group shows a photoconductivity to visible rays even without addition of a charge-generating pigment.

16 Claims, 1 Drawing Sheet

ORGANIC PHOTOCONDUCTIVE MATERIAL FOR ELECTROPHOTOGRAPHY

BACKGROUND OF THE INVENTION (1) Field of the Invention

The present invention relates to a polymer-type photoconductive material for electrophotography, which is effectively used as an electrophotographic photosensitive material or a photoconductive toner.

(2) Description of the Related Art

As a practical material comprising an organic photoconductive compound, there can be mentioned a photosensitive material for telectrophotography.

Polymeric photoconductive compounds such as polyvinyl carbazole (PVCz) and low-molecular-weight photoconductive compounds such as hydrazone derivatives are known as the organic photoconductive compound to be used for a photosensitive material for electrophotography.

Known photoconductive polymers such as PVCz have no conductivity to visible rays, and low-molecular-weight photoconductive compounds such as hydrazone compounds do not generate carriers under visible rays and therefore, they cannot be used singly as the photosensitive material. Accordingly, there has been adopted a method in which these low-molecular-weight photoconductive compounds are combined with charge-generating pigments to produce a sensitivity to rays of the visible region. Therefore, in order to obtain a photosensitive material for electrophotography by using a low-molecular-weight photoconductive compound as mentioned above, it is necessary to disperse a charge-generating pigment in a binder polymer.

It is very difficult to disperse a pigment, generally insoluble in a solvent, homogeneously in a binder polymer, and even if the pigment can be homogeneously dispersed, the stability of the dispersion is not good.

Furthermore, since the pigment is an agglomerate, differences in preparation of conditions have a great influence on the electrophotographic characteristics of the obtained photosensitive material. Accordingly, in order to eliminate these influences, it is necessary to control the physical properties of the pigment.

SUMMARY OF THE INVENTION

It is therefore a primary object of the present invention to provide a photoconductive material for electrophotography, which shows a photoconductivity under visible rays without the aid of a charge-generating pigment. In accordance with the present invention, there is provided a photoconductive material for electophotography, which comprises a linear high-molecular-weight polymer in which a rhodanine derivative having the following structural formula is introduced as a substituent

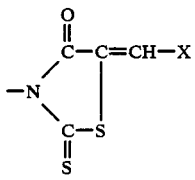

(1)

wherein X is a substituent selected from the group consisting of (i)

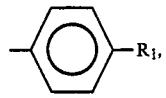

(ii)

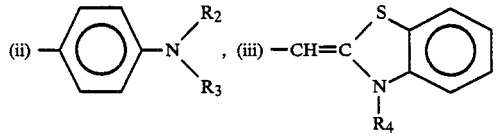

(iii)

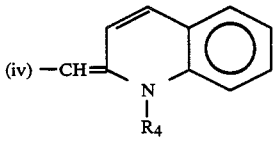

(iv)

and (v)

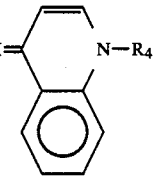

in which $R_1$ stands for a lower alkyl group having up to 6 carbon atoms or a hydroxyl group, $R_2$ and $R_3$ stands for a hydrogen atom, a substituted or unsubstituted aryl group or a hydroxyl group, and $R_4$ stands for a hydrogen atom, a lower alkyl group having up to 6 carbon atoms, a substituted or unsubstituted aryl group or a hydroxyl group.

DETAILED DESCRIPTION OF THE INVENTION

Figure 1:
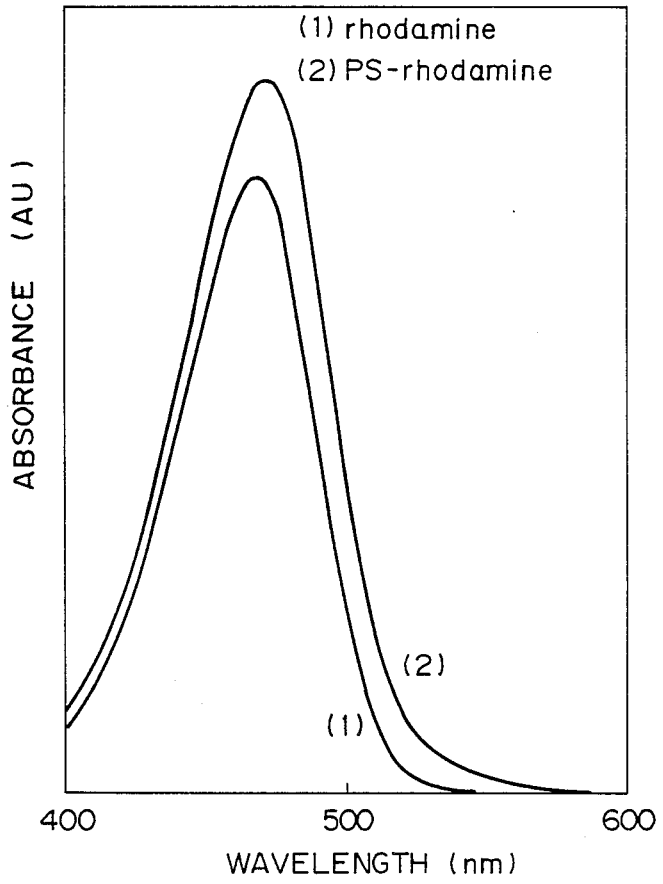
FIG. 1 shows absorption spectra of 3-carboxylmethyl-5-(p-diethylaminobenzylidene)rhodanine and polystyrene having this compound supported in the side chain thereof.

The linear high-molecular-weight polymer constituting the electrophotographic photoconductive material of the present invention is characterized in that it has a rhodanine derivative group represented by the above-mentioned general formula (1) as a substituent.

This rhodanine derivative group is divided into the following three types according to the kind of the group located at the 5-position of the rhodanine ring.

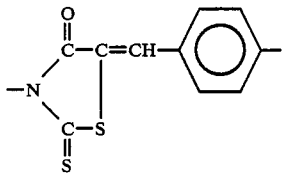

(a)

A benzylidene group is bonded to the 5-position of the rhodanine ring. In this case, X in the general formula (1) is a substituent (i) or (ii).

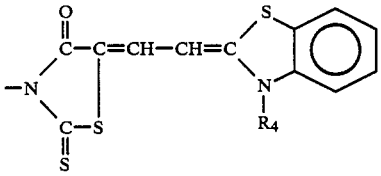

(b)

A benzothiazoline group is bonded to the 5-position of the rhodanine ring through an ethane-diylidene group. In this case, X is a substituent (iii).

(c)

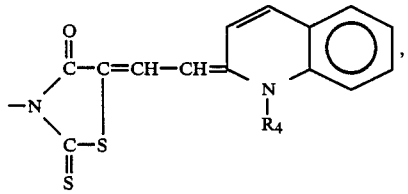

or

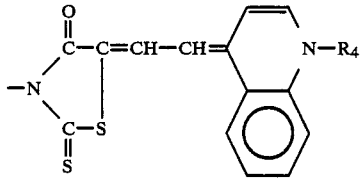

A quinoline group is bonded to the 5-position of the rhodanine ring through an ethane-diylidene group. In this case, X is a substituent (iv) or (v). In the rhodanine derivative group introduced as the substituent in the linear high-molecular-weight polymer, the rhodanine ring portion acts as an electron receptor and the substituent group portion bonded to the 5-position of the rhodanine ring acts as an electron donor, and under irradiation with visible rays, a complex of the intramolecular migration type is formed.

More specifically, $\pi$-electrons delocalized in the electron donor in the ground state absorb light energy under irradiation with visible rays and migrates into a vacant orbit of the electron receptor through "=CH—CH=" of the conjugated bond, with the result that coloration is caused. A photocarrier is generated by this photoexcitation.

Accordingly, it will be understood that the high-molecular-weight polymer of the present invention shows a conductivity under visible rays when combined with a charge-transporting material.

In the polymer of the present invention, especially one having a rhodanine derivative group of the type (a), by introducing a lower alkyl group or hydroxyl group into the p-position of the benzylidene group, the absorption wavelength can be shifted to the shorter wavelength side in the visible ray region.

Since the rhodanine derivative-introduced polymer of the present invention has a charge-generating capacity and inherent characteristics of the base polymer, such as a film-forming property and a transparency, if the polymer is combined with a charge-transporting material such as a hydrazone derivative, a triphenylamine derivative or a pyrazoline derivative, there can be formed a polymer-type photoconductive material in which a photo-carrier generated in the polymer can move through a hole-transporting material dissolved in the polymer.

In this case, since a pigment or the like is not dispersed in the photoconductive material, not only the film-forming property but also the transparency and stability are highly improved.

Accordingly, if a charge-transporting material is incorporated in the polymer of the present invention and the formed composition is coated on an electroconductive substrate, a single-layer photosensitive material can be obtained. Moreover, a laminate photosensitive material can be formed by combining a charge-generating layer of the polymer of the present invention with a known charge-transporting layer. Furthermore, a photoconductive toner can be formed by incorporating a charge-transporting material and other necessary additives into the polymer of the present invention and granulating the composition.

SYNTHESIS OF RHODANINE DERIVATIVE

For the production of the above-mentioned polymer of the present invention having a charge-generating capacity, a rhodanine derivative representative by the following general formula:

(2)

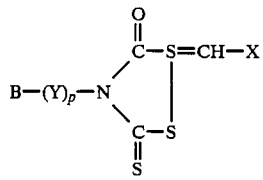

wherein B stands for a reactive substituent such as —COOH, —$CICH_2$—OH, —COCl or —$NH_2$, Y stands for an alkylene group having up to 4 carbon atoms, such as a methylene or ethylene group, an arylene group such as a phenylene group, or a carbonyloxyalkylene group such as a carbonyloxyethylene or carbonyloxypropylene group, p is an integer of 0 or 1, and X is a substituent as defined above, is first synthesized as a component for introducing a rhodanine derivative group of the general formula (1) into the polymer.

The rhodanine derivative represented by the general formula (2) can be synthesized according to various processes.

For example, a rhodanine derivative corresponding to the derivative group of the type (a) can be synthesized by reacting a 3-substituted rhodanine with an equimolar amount of a p-substituted benzaldehyde.

This reaction can be expressed by the following formula:

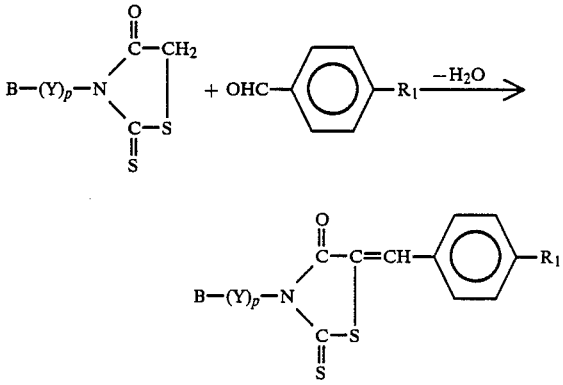

Furthermore, a rhodanine derivative corresponding to the derivative group of the type (a) can be synthesized by reacting a 3-carboxyalkylrhodanine with an equimolar amount of p-aminobenzaldehyde, p-dialkylaminobenzaldehyde or p-diarylaminobenzaldehyde. This reaction can be expressed, for example, by the following formula:

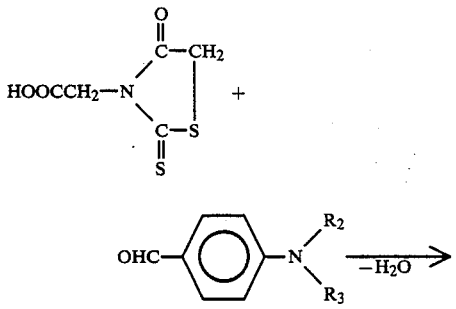

-continued

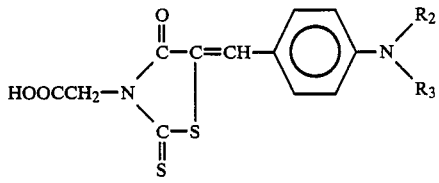

A rhodanine derivative corresponding to the derivative group of the type (b) can be synthesized by reacting a 3-substituted rhodanine with a 2-β-acetoanilidovinylbenzothiazole alkyliodide in an alcohol. This reaction can be expressed by the following formula:

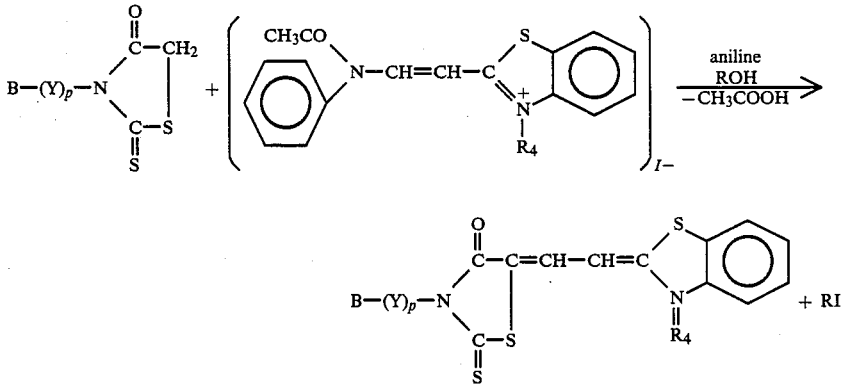

A rhodanine derivative corresponding to the derivative group of the type (c) can be synthesized by reacting a 3-substituted rhodanine with a 2β-acetoanilidovinylquinoline alkyliodide or 4-β-acetoanilidovinylquinoline alkyliodide in an alcohol. This reaction can be represented by the following formula:

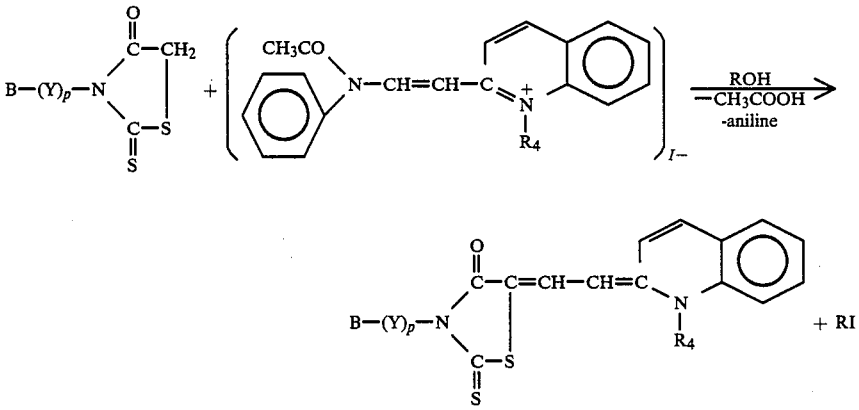

or

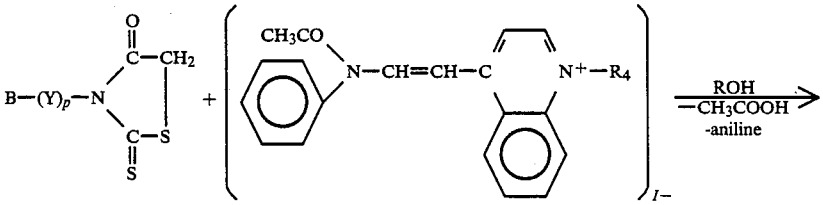

-continued
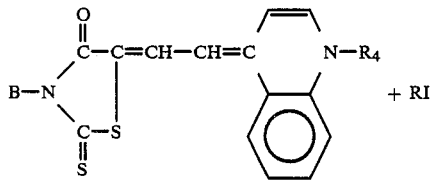
As specific examples of the above-mentioned rhodanine derivative, the following compounds can be mentioned.
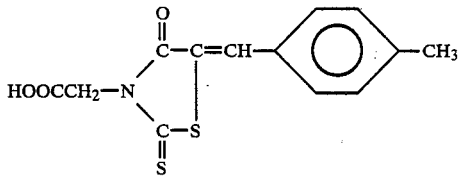
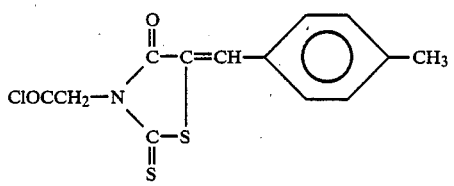
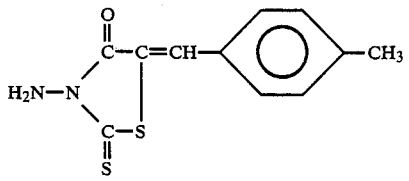
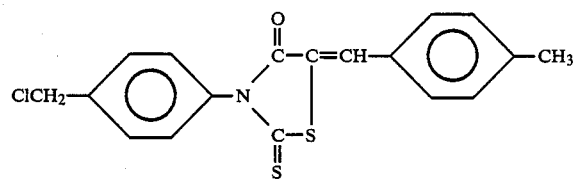
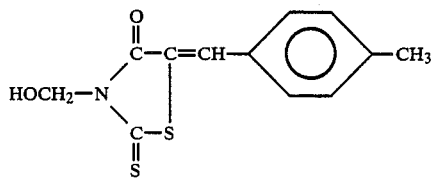
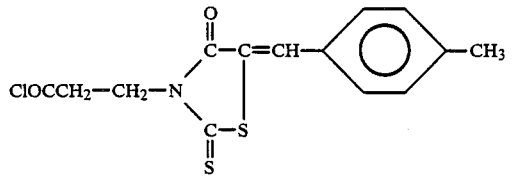

-continued
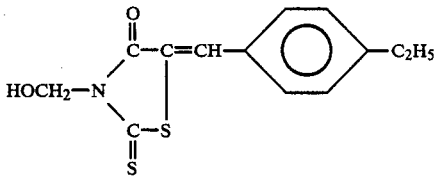
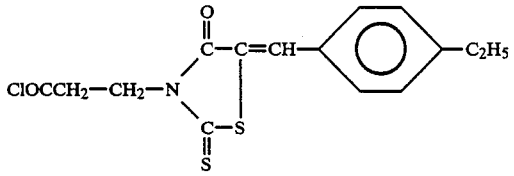
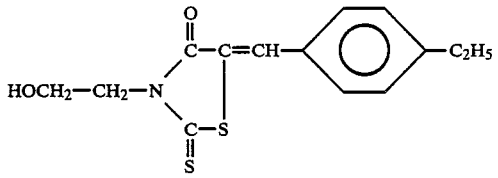
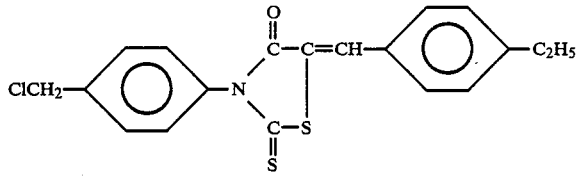
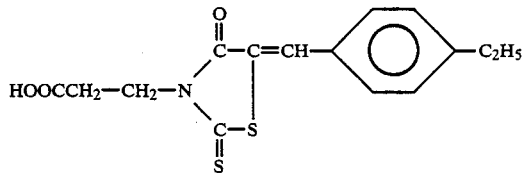
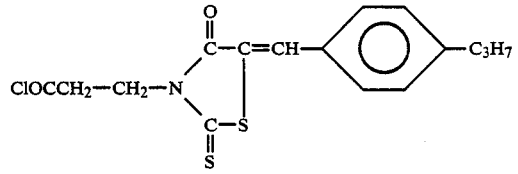
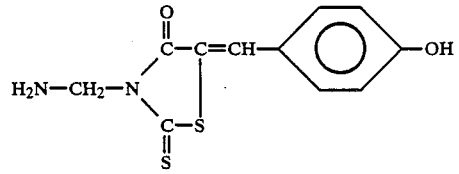
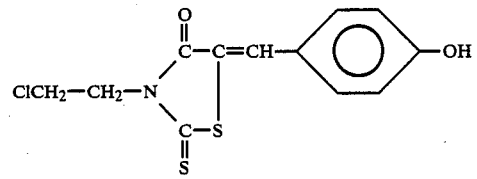

-continued
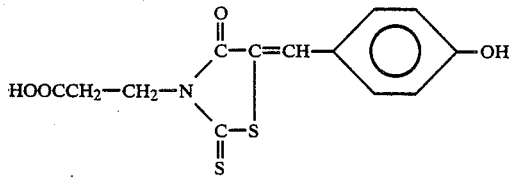
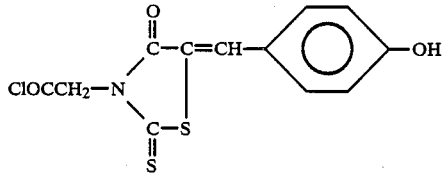
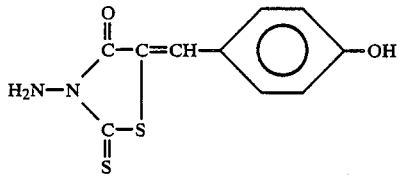
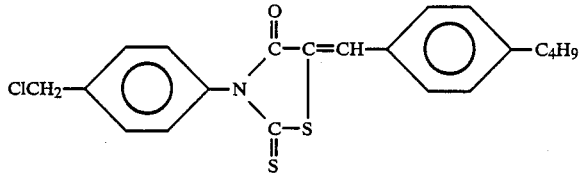
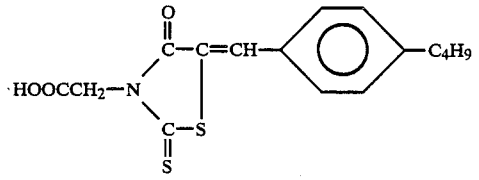
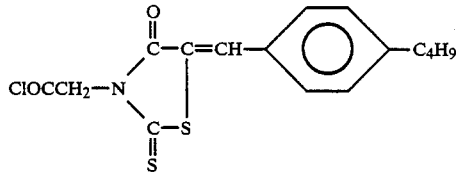
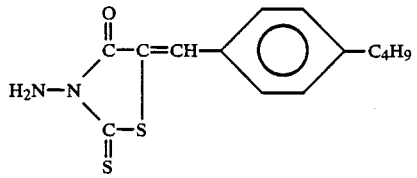
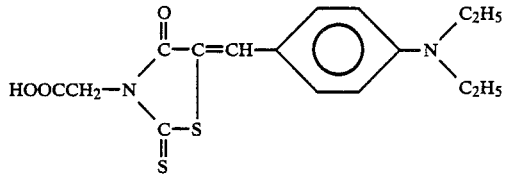

-continued
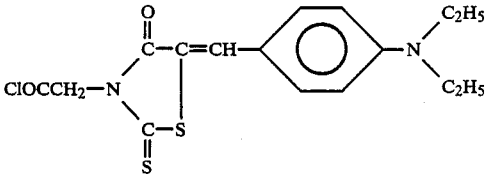
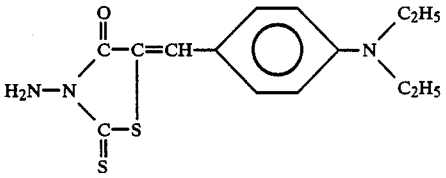
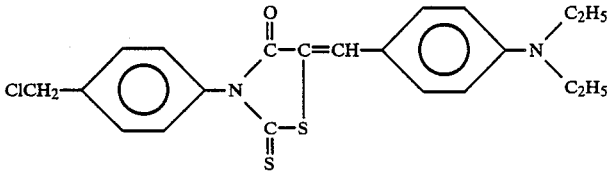
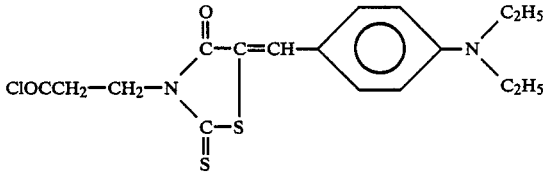
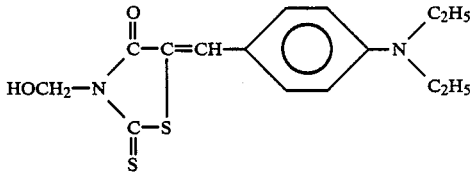
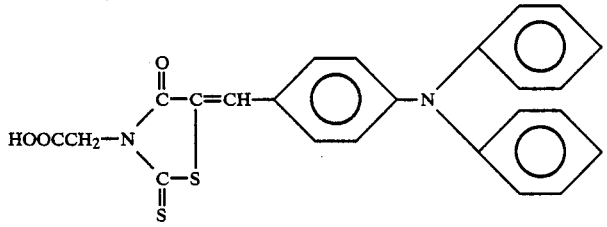
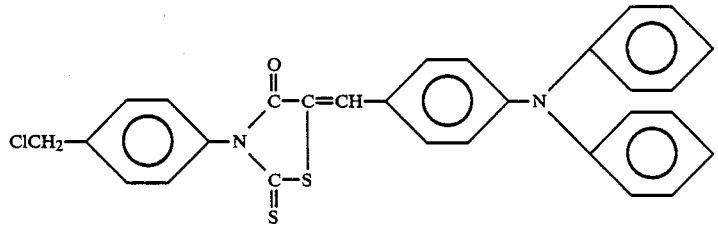

-continued
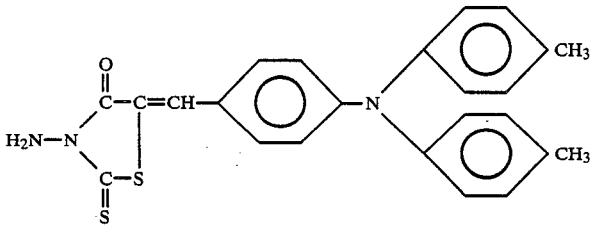
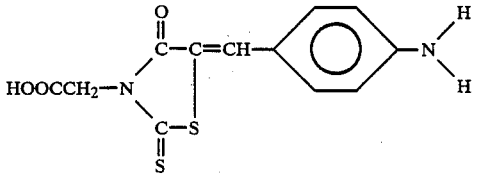
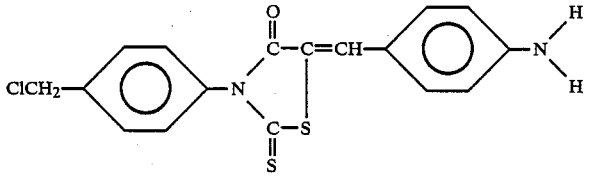
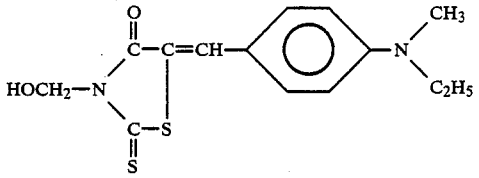
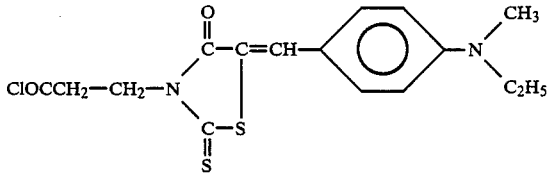
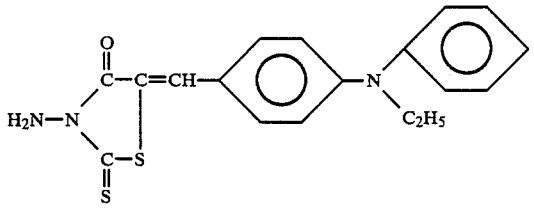
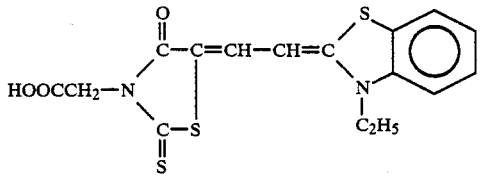
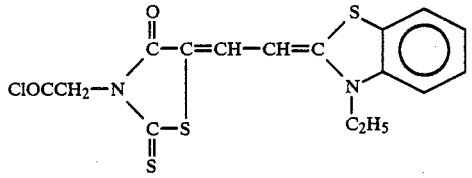

-continued
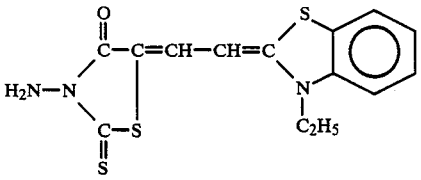
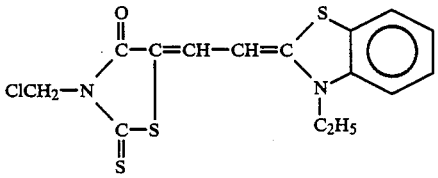
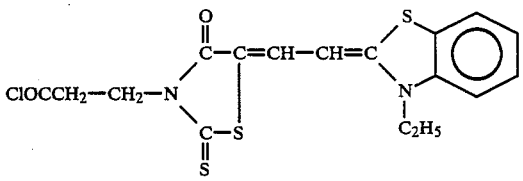
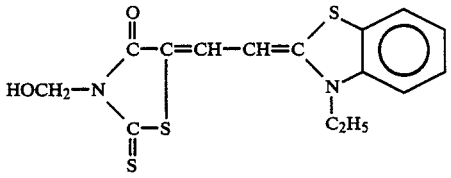
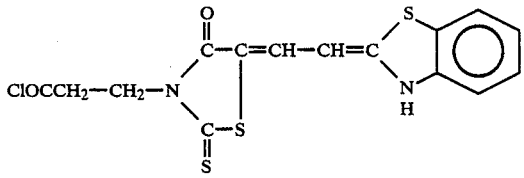
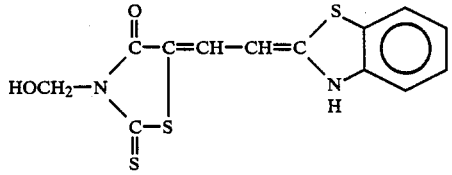
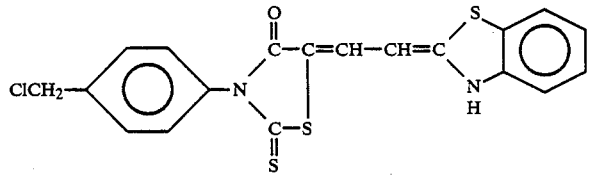
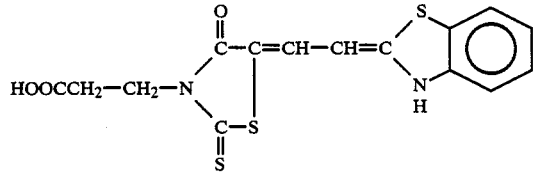

-continued
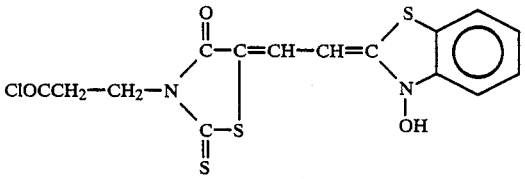
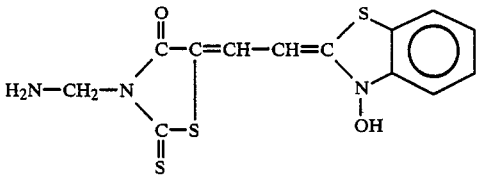
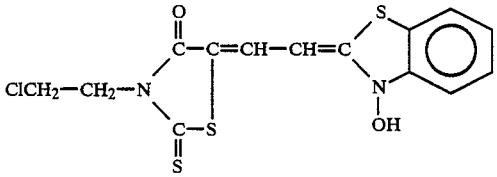
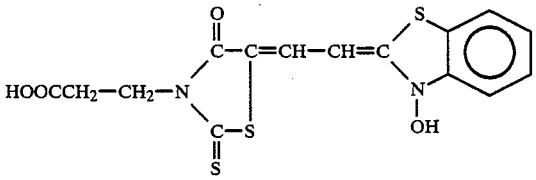
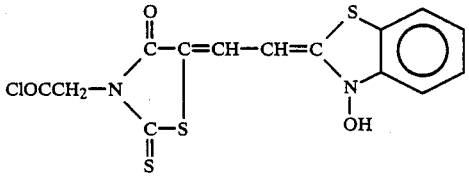
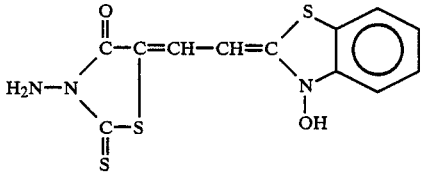
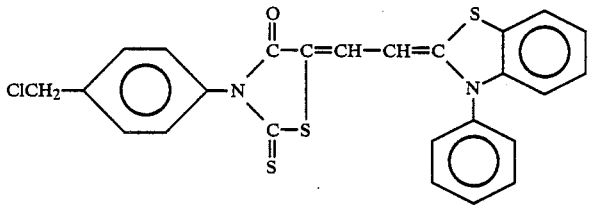
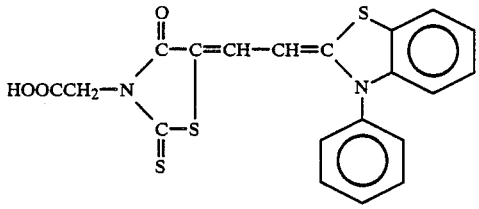

-continued
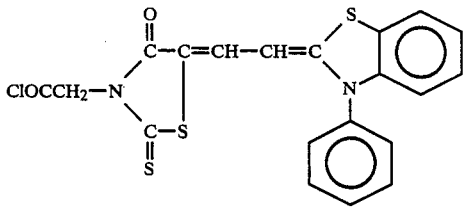
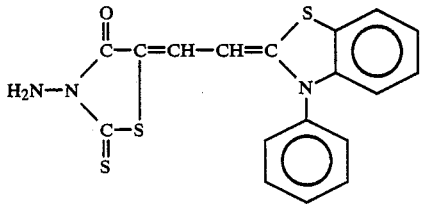
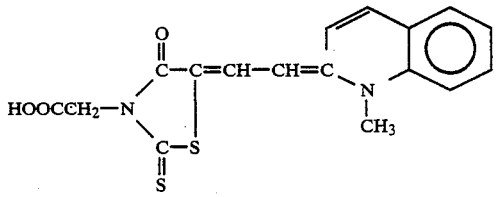
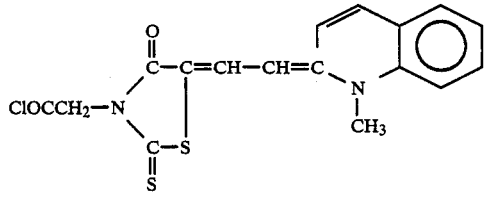
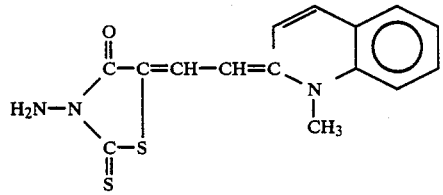
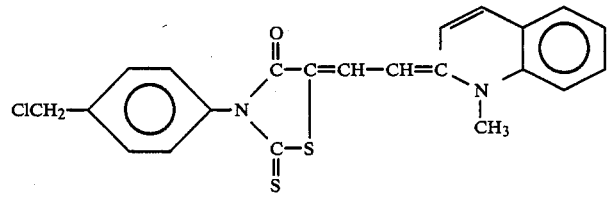
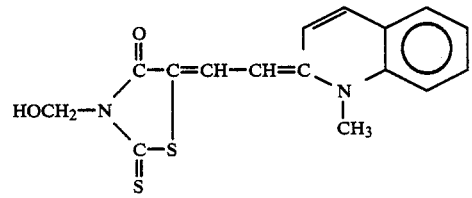

-continued
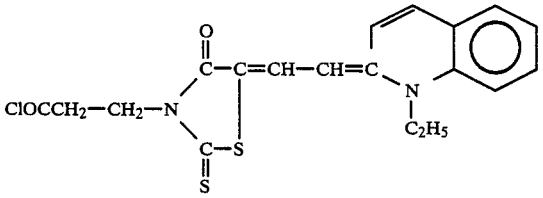
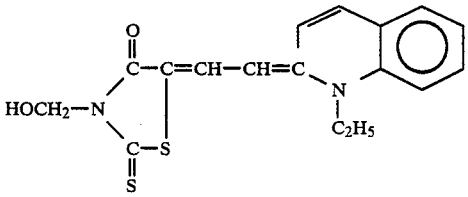
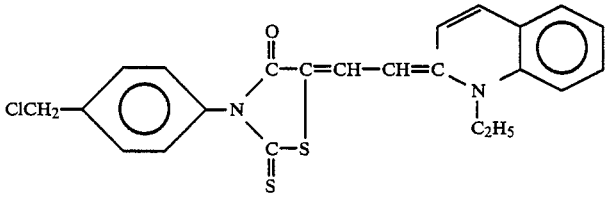
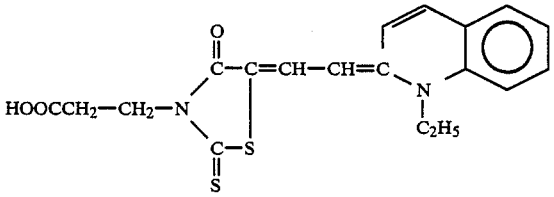
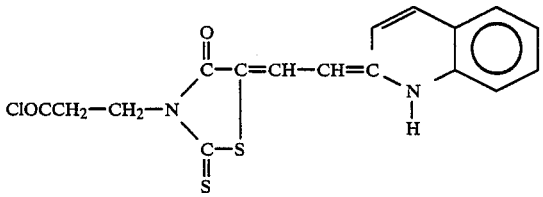
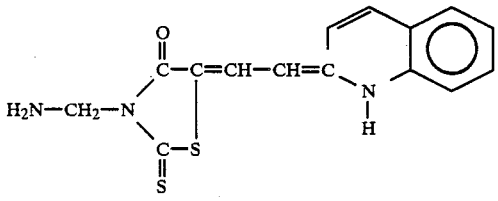
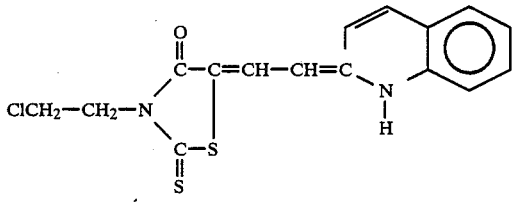

-continued
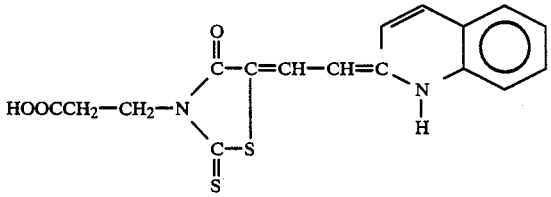
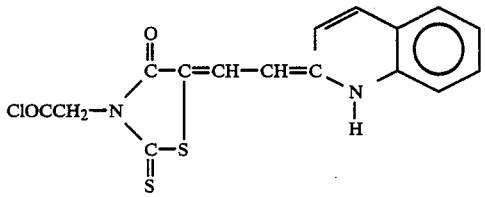
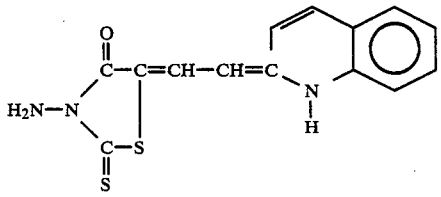
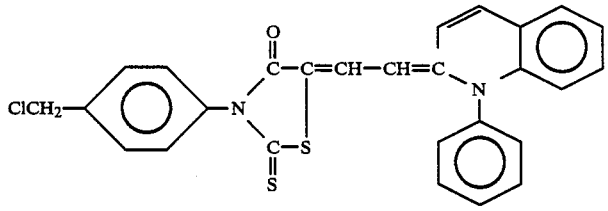
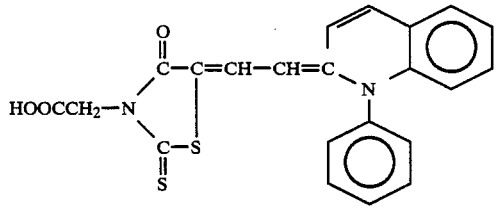
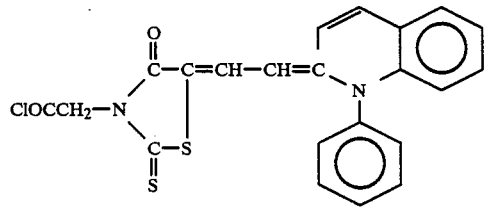
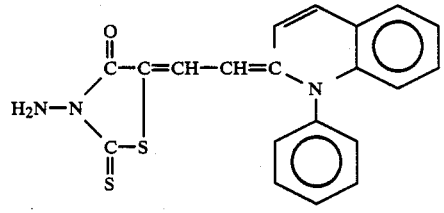

-continued
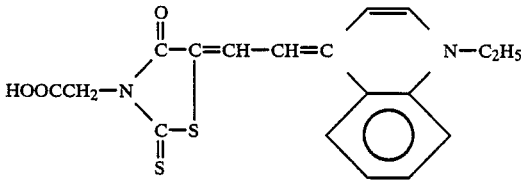
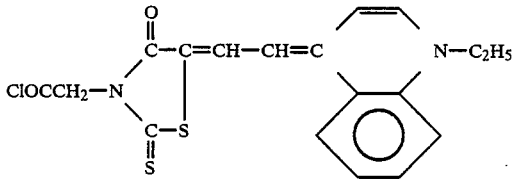
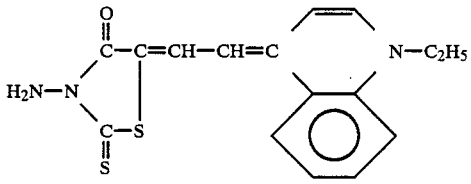
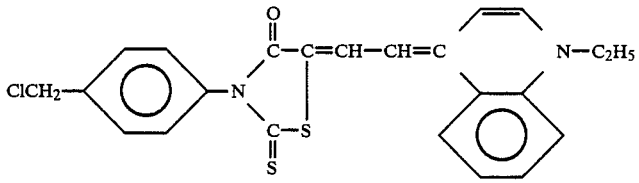
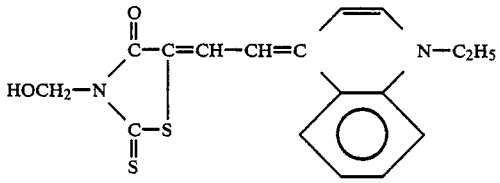
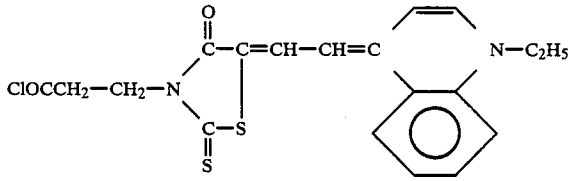
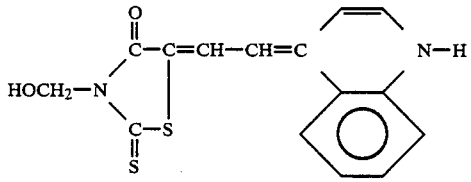
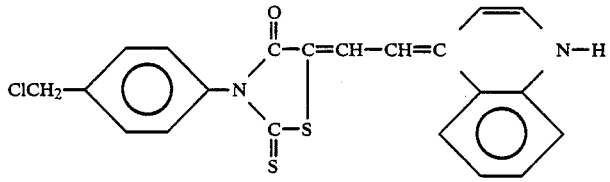

-continued
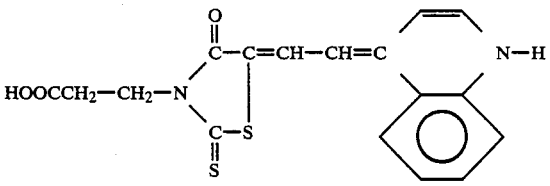
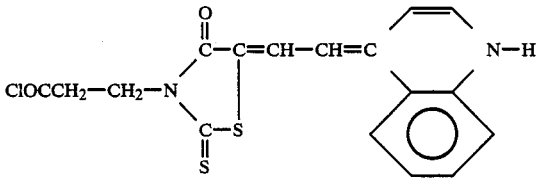
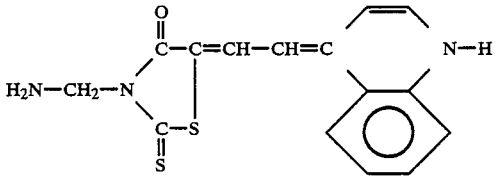
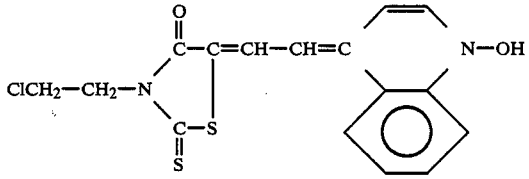
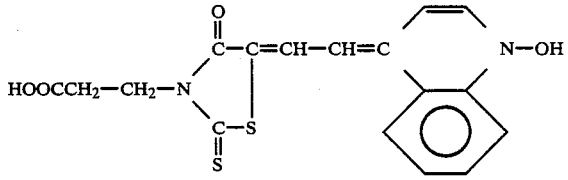
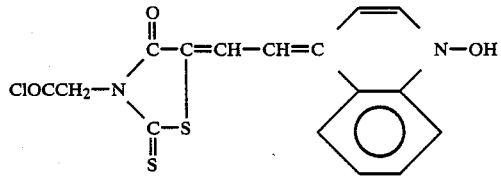
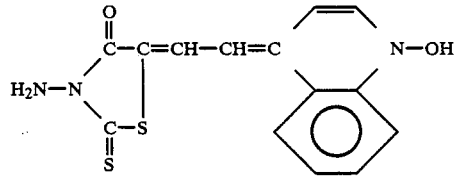
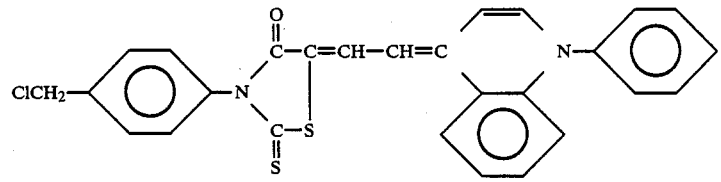

-continued

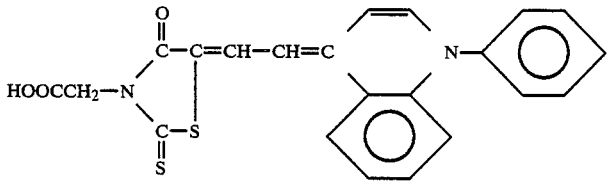

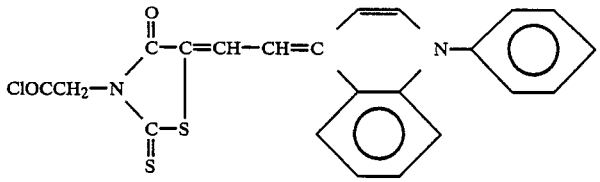

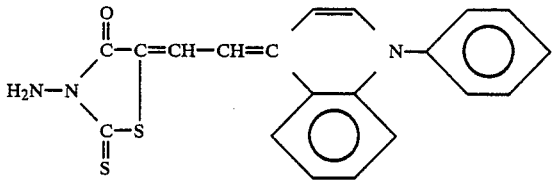

SYNTHESIS OF LINEAR HIGH-MOLECULAR-WEIGHT POLYMER

The linear high-molecular-weight polymer of the present invention is synthesized by using the above-mentioned rhodanine derivative. The synthesis process is roughly divided into the following two types.

(First Process)

The above-mentioned rhodanine derivative is reacted with an appropriate monomer to introduce a rhodanine derivative group of the general formula (1) into the monomer, and this monomer is polymerized to obtain an intended linear high-molecular-weight polymer.

Any of monomers having a reactive substituent, such as styrene type monomers, ethylene type monomers and acrylic or methacrylic monomers can be used as the monomer.

As preferred examples of the monomer, there can be mentioned styrene type monomers represented by the following general formula:

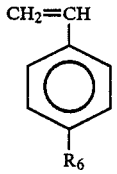

wherein $R_6$ stands for $-CH_2Cl$, $-NH_2$, $-SO_2Cl$ or $-COOH$, ethylene type monomers represented by the following general formula:

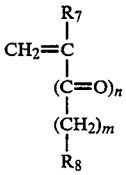

wherein $R_7$ stands for a hydrogen atom or a methyl group, $R_8$ stands for a reactive substituent group such as $-COOH$, COCl, $-OH$ or $-NH_2$, n is 0 or 1, and m is an integer of from 0 to 3, and acrylic or methacrylic monomers represented by the following formula

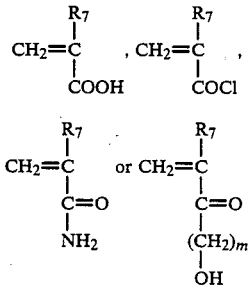

wherein $R_7$ and m are as defined above.

The reaction between the above-mentioned monomer and the rhodanine derivative can be performed according to, for example, processes represented by the following formulae.

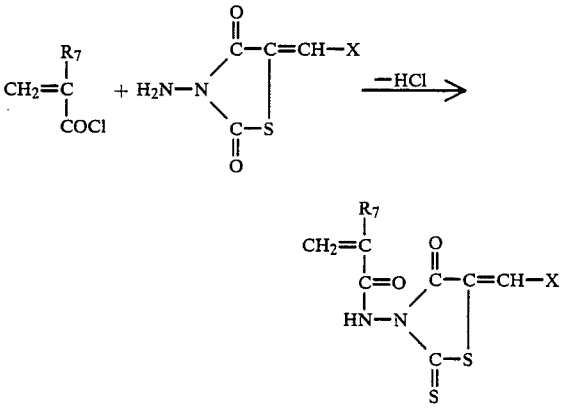

(In case of B = OH)

-continued

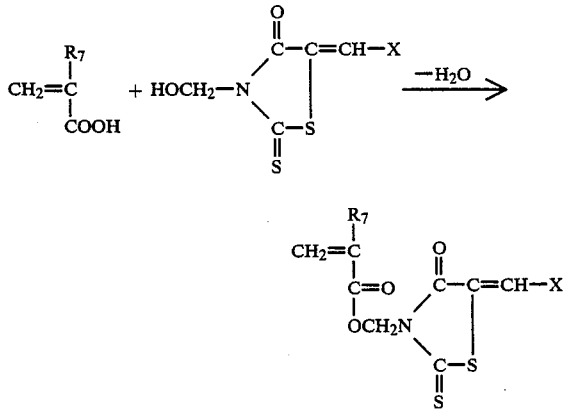

(In case of B = —COOH)

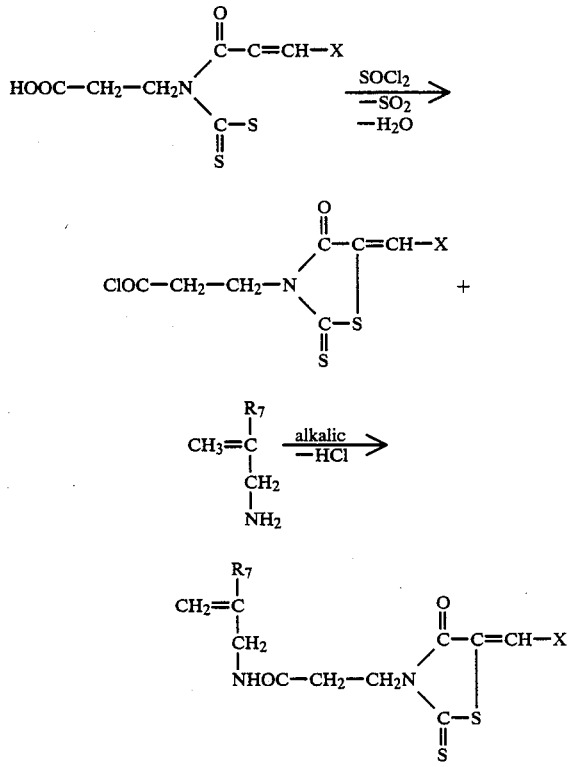

(In case of B = —COCl)

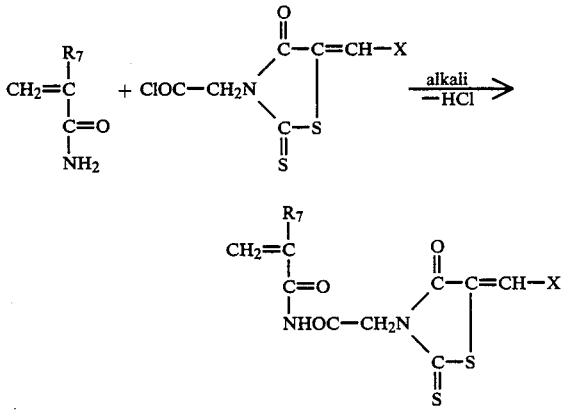

(In case of B = —CClH2)

-continued

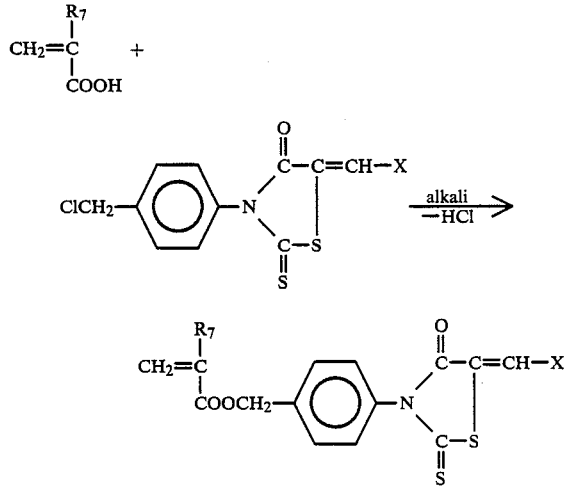

As the alkali in the above-mentioned reaction formulae, there can be mentioned pyridine, triethylamine and the like.

The above-mentioned rhodanine derivative-introduced monomer can be easily polymerized by heating the monomer in the presence of a radical initiator, for example, an azo compound such as azobisisobutyronitrile, or a peroxide such as benzoyl peroxide, cumene hydroperoxide, t-butyl hydroperoxide or lauroyl peroxide in a solvent such as tetrahydrofuran, benzene, dimethylformamide or dichloromethane.

It is preferred that the concentration of the radical initiator be 0.01 to 0.1 mole % based on the monomer. The polymerization temperature is changed according to the kind of the radical initiator, but it is generally preferred that the polymerization temperature be 30° to 100° C. It also is preferred that the polymerization time be 20 to 50 hours. The weight average molecular weight of the obtained polymer can be adjusted within a broad range of 10,000 to 40,000 by appropriately controlling the monomer concentration, the radical initiator concentration and the polymerization temperature.

In the polymer obtained according to the first synthesis process, rhodanine derivative groups are regularly present in the side chains of the linear polymer, and therefore, the number of rhodanine groups present in the linear polymer is very large and the light absorption efficiency is increased, with the result that a polymer having a high carrier-forming efficiency can be obtained.

Accordingly, if this polymer is dissolved in an appropriate solvent and the composition is coated and dried, charge-generating sites can be formed at such a high density as attainable by vacuum deposition.

(Second Process)

According to this process, a polymer having a reactive group is reacted with the above-mentioned rhodanine derivative to obtain an intended rhodanine derivative group-introduced polymer.

Furthermore, an intended linear high-molecular polymer can be synthesized by copolymerizing a rhodanine derivative group-containing monomer with a rhodanine derivative group-free polymer. This process is advantageous in that the content of the rhodanine derivative group in the polymer can be appropriately controlled.

A polymer having a halomethyl group as the reactive substituent is preferably used as the polymer to which the above-mentioned rhodanine derivative is bonded. For example, a vinyl type polymer having recurring units represented by the following formula:

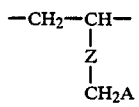

wherein Z stands for a divalent organic group, for example, an alkylene group having up to 4 carbon atoms, such as a methylene group or an ethylene group, an arylene group such as a phenylene group, or a carbonyloxyalkylene group, preferably a phenylene group, and A stands for a halogen atom, is preferably used.

More specifically, there can be mentioned styrene type polymers, acrylic polymers and methacrylic polymers, and styrene type polymers are preferred.

The reaction between a polymer as mentioned above and the rhodanine derivative is accomplished by nucleophilic reaction producing an ester linkage.

This reaction will now be described below with reference to an example where 3-carboxymethyl-5-(p-dimethylaminobenzylidene)rhodanine is ester-bonded as the rhodanine derivative to chloromethylated polystyrene.

This reaction is represented by the following reaction formulae:

(3)

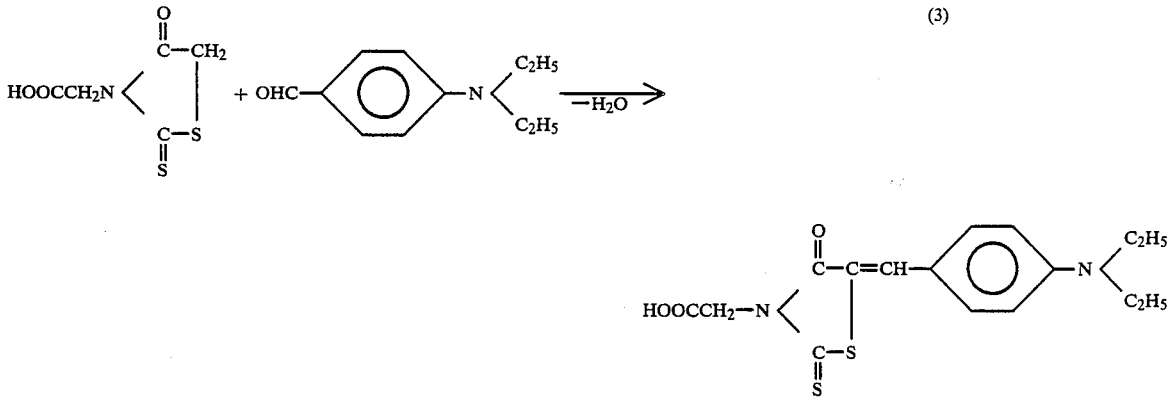

(4)

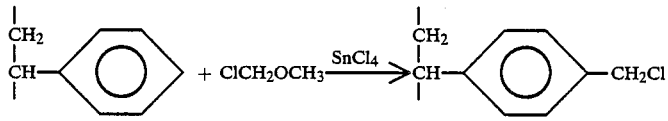

(5)

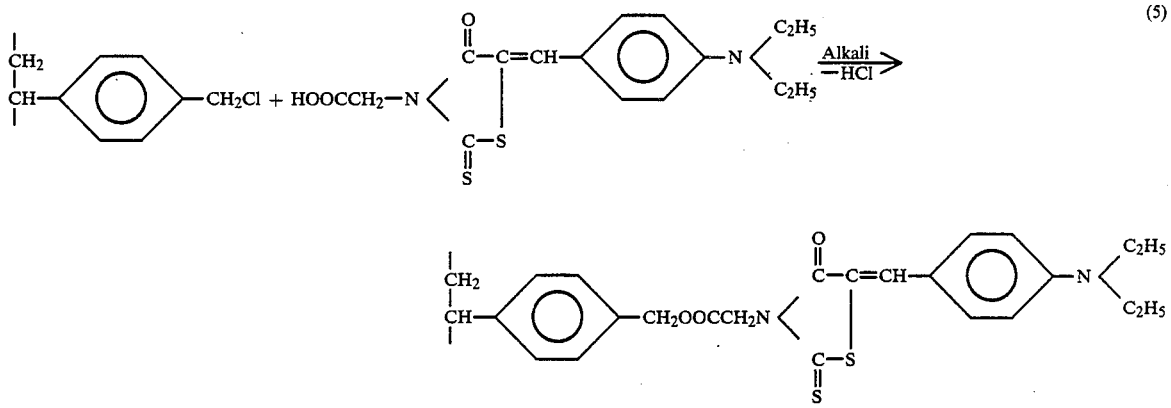

In the reaction of the formula (3), 3-carboxymethyl-5-(p-diethylaminobenzylidene)rhodanine is obtained in a yield of 87%, and the reaction between the chloromethylene units in chloromethylated polystyrene and 3-carboxymethyl-5-(p-diethylaminobenzylidene)rhodanine is advanced in a yield of almost 100%.

Polymers of the present invention having other substituent introduced in the 5-position of the rhodanine ring can be synthesized according to similar reactions.

The reaction can be easily accomplished by conducting heating at a temperature of 80° to 120° C. for 2 to 5 hours in the presence of an alkali such as triethylamine in a non-protonic polar solvent such as dimethylformamide.

A polymer having recurring units represented by the above-mentioned formula can be easily obtained by polymerizing recurring units having a halomethyl group or by halomethylating polystyrene.

When an intended polymer is obtained according to this synthesis process, it is preferred that the rhodanine derivative group be present in an amount of 20 to 50% by weight, especially 30 to 40% by weight, based on the polymer. It also is preferred that the weight average molecular weight of the polymer be 15,000 to 200,000, especially 20,000 to 150,000.

PHOTOCONDUCTIVE MATERIAL

A photoconductive material for the electrophotography is formed by combining the so-obtained polymer with a charge-transporting material.

Known electron-transporting substances and hole-transporting substances can be used as the charge-transporting material. More specifically, there can be mentioned electron-receiving substances, for example, fluorenone compounds such as tetracyanoethylene and 2,4,7-trinitro-9-fluorenone and nitro compounds such as dinitroanthracene and 2,4,8-trinitrothioxanthone, and electron donor substances, for example, hydrazone compounds such as 4-diethylaminobenzaldehydodiphenylhydrazone and N-methyl-3-carbardehydodiphenylhydrazone, oxadiazole compounds 2,5-bis(4-dimethylaminophenyl)-1,3,4-oxadiazole and 2,5-bis(4-diethylaminophenyl)-1,3,4-oxadiazole, styryl compounds 9-(4-diethylaminostyryl)anthracene, carbazole compounds such as N-ethylcarbazole, pyrazoline compounds such as 1-phenyl-3-(4-dimethylaminophenyl)-pyrazoline, 1-phenyl-3-(4-dimethylaminostyryl)-5-(4-dimethylaminophenyl)pyrazoline and 1-phenyl-3-(4-diethylaminostyryl)-5-(4-diethylaminophenyl)pyrazoline, oxazole compounds such as 2-(4-diethylaminophenyl)-4-(4-dimethylaminophenyl)-5-(2-chlorophenyl-)oxazole, isooxazole compounds thiazole compounds such as 2-(4-diethylaminostyryl)-5-diethylaminobenzothiazole, amine derivatives such as triphenylamine and 4,4'-bis N-(3-methylphenyl)-N-phenylamino biphenyl, nitrogen stilbene compounds, ring cyclic compounds such as thidiazole compounds, imidazole compounds, pyrazole compounds, indole compounds and triazole compounds, condensed polycyclic compounds such as anthracene, pyrene and phenanthrene, and poly-N-vinylcarbazole, polyvinylpyrene, polyvinylanthracene and an ethylcabazole-formaldehyde resin. These charge-transporting substances can be used singly or in the form of mixtures of two or more of them.

PHOTOSENSITIVE MATERIAL

A single-layer photosensitive material can be prepared by incorporating a charge-transporting substance as described above into the above-mentioned polymer and coating the composition on an electroconductive substrate. In this case, it is preferred that the charge-transporting substance be incorporated in an amount of 20 to 100% by weight, especially 40 to 80% by weight, based on the rhodanine ring-containing polymer.

In case of a laminate photosensitive material, the above-mentioned charge-transporting substance is incorporated in a binder resin having a film-forming property in an amount of 30 to 150% by weight, preferably 50 to 100% by weight, based on the binder resin and a charge-transporting layer is formed. As the binder resin, there can be mentioned a styrene polymer, a styrene/-butadiene copolymer, a styrene/acrylonitrile copolymer, a styrene/maleic acid copolymer, an acrylic polymer, a styrene/acrylic copolymer, an ethylene/vinyl acetate copolymer, polyvinyl chloride, a vinyl chloride/vinyl acetate copolymer, a polyester, an alkyd resin, a polyamide, a polyurethane, an acrylicmodified urethane resin, an epoxy resin, a polycarbonate, a polyarylate, a polysulfone, a diallyl phthalate, a silicone resin, a ketone, a polyvinylbutyral resin, a polyether resin and a phenolic resin, though resins that can be used are not limited to those mentioned above. For the production of the photosensitive material, a blocking layer is formed according to need, and the polymer having a charge-generating capacity and the charge-transporting substance are dispersed and dissolved at the above-mentioned ratio in a solvent and a single-layer photosensitive layer is formed.

A laminate photosensitive material can be prepared by coating a solution of the polymer having a charge-generating capacity in a solvent on the above-mentioned substrate to form a charge-generating layer and coating a coating liquid formed by incorporating the charge-transporting substance in the binder resin on the charge-generating substance to form a charge-transporting layer. Alternately, a photosensitive material can be prepared by forming a charge-generating layer on a charge-transporting layer in a manner similar to that mentioned above.

PHOTOCONDUCTIVE TONER

A composition comprising the above-mentioned polymer and charge-transporting material can be used for the production of a photoconductive toner. Since the polymer per se has a sharp hue and a transparency, a photoconductive toner which can be used even as a toner for OHP can be prepared from this composition.

In order to obtain a photoconductive toner, it is necessary that the toner powder as the final product should have properties required for the toner.

Accordingly, the combination ratio between the polymer and the charge-transporting material should be changed to some extent from the ratio adopted for the production of a photosensitive material. More specifically, in view of the fixing property and coherent property, the charge-transporting material is added in an amount of 20 to 50 parts by weight, preferably 30 to 40 parts by weight, per 100 parts by weight of the polymer.

In the case where the toner is used for the heat fixation, the degree of polymerization is adjusted so that the softening point of the polymer is 50° to 200° C., preferably 70° to 170°C. The softening point can also be adjusted by blending a known binder resin for a toner, which has a good compatibility with the polymer of the present invention, such as a styrene resin, an acrylic resin or a polyester resin.

In the case where the toner is used for the pressure fixation, a polymer that can easily undergo plastic deformation, for example, an olefin polymer such as a polyfluoroethylene resin, is mainly used.

The rhodanine ring-introduced polymer used in the present invention shows a good photoconductivity when combined with a charge-transporting material.

Furthermore, the polymer per se shows a sharp and clear color determined according to the kind of the substituent introduced in the 5-position of the rhodanine ring. Therefore, according to the present invention, a transparent colored photoconductive toner can be obtained without using a colorant.

As the colorant for coloring the photoconductive toner in black or other hue, there can be mentioned, for example, carbon black, lamp black (C.I. No. 77266), Chrome Yellow (C.I. No. 14090), Hansa Yellow (C.I. No. 11660, 11680, etc.), Benzidine Yellow (C.I. No. 21100, etc.), Sulen Yellow G (C.I. No. 70600), Quinoline Yellow (C.I. No. 47005), Permanent Orange GTR (C.I. No. 12305), Plazon Orange (C.I. No. 21160), Watchung Red (C.I. No. 15868), permanent Red (C.I. No. 12310, etc.), Brilliant Carmine 3B (C.I. No. 16105), Brilliant Carmine 6B (C.I. No. 15850), Du Pond Oil Red (C.I. No. 26105), Pyrazolone Red (C.I. No. 22120), Lithol Red (C.I. No. 15630), Rhodamine B Lake (C.I. No. 45170), Lake Red C (C.I. No. 45435), Aniline Blue (C.I. No. 77103), Chalco Oil Blue (C.I. Azoec Blue 3), Methylene Blue Chloride (C.I. No. 52015), Phthalocyanine Blue (C.I. No. 74260), Marachite Green Oxalate (C.I. No. 42000), Noigrosine dyes, Spiron Black, and oil soluble dyes such as C.I. Solvent Yellow 60, C.I. Solvent Red 27, C.I. Solvent Blue 35, C.I. Solvent Green 15 and C.I. Solvent Brown 5. In view of the photoconductivity and coloring property, an oil-soluble dye is preferred.

These colorants can be used singly or in the form of mixtures of two or more of them. For example, the colorant is used in an amount of 1 to 30 parts by weight, preferably 2 to 20 parts by weight, per 100 parts by weight of the binder resin. If necessary, in order to control the charge of the toner, the above-mentioned toner can contain a charge-controlling agent, for example, an oil-soluble dye such as Nigrosine dye (C.I. No. 50415B), Oil Black (C.I. No. 26150) or Spiron Black, a metal soap such as a manganese, iron, cobalt, lead, zinc, cerium, calcium or nickel salt of naphthenic acid, salicylic acid, octylic acid, a fatty acid or a resin acid, a metal-containing azo dye, a pyrimidine compound or a metal alkyl salicylate chelate. The charge-controlling agent can be incorporated in an amount of 0.01 to 5% by weight based on the binder resin.

Moreover, in order to prevent adhesion of the toner to a fixing roller, an offset-preventing agent, for example, a wax such as low-molecular-weight polypropylene, low-molecular-weight polyethylene or paraffin wax, a low polymer of an olefin having up to 4 carbon atoms, a fatty acid amide or a silicone oil can be added to the toner in an amount of 0.5 to 15% by weight based on the toner.

If necessary, in order to improve the flowability of the toner, the surface treatment with an external additive such as a silane coupling agent, a silicone or a fluorine compound can be carried out.

The photoconductive toner of the present invention can be prepared by mixing the polymer and the colorant, kneading the mixture and pulverizing the kneaded mixture, or by incorporating and dispersing the above-mentioned mixture in an appropriate solvent and spray-drying the solution to form a toner having a particle size of 5 to 50 μm.

For formation of an image by using the toner of the present invention, a metal sheet such as an aluminum plate or tin plate, a drum thereof or a transparent electroconductive substrate such as a Nesa glass sheet can be used as the substrate. Known optional means can be adopted for formation of a toner image on the substrate. For example, there can be adopted a method in which the above-mentioned toner composition is mixed with a magnetic carrier to form a two-component type developer, the developer is supplied onto a sleeve having a magnet arranged therein to form a magnetic brush, and the electroconductive substrate is brought in sliding contact with this magnetic brush to form a toner layer on the substrate. Furthermore, a toner layer can be formed on the electroconductive substrate by supporting a charged toner on a fur brush and bringing the electroconductive substrate in sliding contact with the supported charged toner. In this case, if a bias voltage is applied between the electroconductive substrate and the sleeve or fur brush, formation of the toner layer is facilitated. Although the toner per se of the toner layer formed on the photosensitive substrate is charged, the toner layer may be forcibly charged by Corotron or the like, if necessary. The thickness of the toner layer is adjusted so that toner particles are present in one to several layers, and the amount applied of the toner per unit area is generally 8 to 50 g/m$^2$.

The imagewise exposure can be accomplished by uniform light exposure of the entire surface using a flash lamp or the like or by slit light exposure using a halogen lamp or the like. The light exposure quantity is greatly changed according to the sensitivity of the toner, but it is generally preferred that the light exposure quantity be 50 to 200 lux.sec.

A known corona discharge transfer method or roller electrode transfer method can be used as the transfer means. The fixing operation can be accomplished by a press-heating roller having a heater built therein or an oven heater. It is preferred that the fixing temperature be 160° to 200° C.

The present invention will now be described in detail with reference to the following examples that by no means limit the scope of the invention.

SYNTHESIS EXAMPLE 1

This example illustrates the synthesis of a polymer comprising an N-substituted-5-(p-diethylaminobenzylidene)rhodanine supported on the side chain of polystyrene.

(a) First Synthesis Process

In 30 ml of dimethylformamide were dissolved 3.82 g of 3-carboxymethylrhodanine and 3.54 g of p-diethylaminobenzaldehyde, and the solution was stirred at 100° C. for 3 hours. After termination of the reaction, the solution was poured into water, and the formed precipitate was recovered by filtration, washed with water and recrystallized from acetone to obtain 3-carboxymethyl-5-(p-diethylaminobenzylidene)rhodanine (the yield was 87%).

To 50 ml of triethylamine and 50 ml of DMF were added 3.5 g of 3-carboxymethyl-5-(p-diethylaminobenzylidene)rhodanine and 1.5 g of p-chloromethylstyrene, and reaction was carried out at 90° C. for 3 hours.

After the reaction, the reaction solution was extracted with chloroform, and the extract was added to a 1/1 mixed solution of water and methanol with stirring and the precipitate was washed with an aqueous solution of sodium acetate and an aqueous solution of sodium hydroxide in succession and dried on sodium sulfate. The monomer was crystallized by evaporation of chloroform to obtain a monomer having an N-substituted-5-(p-diethylaminobenzylidene)rhodanine at the p-position of styrene.

Then, 2.5 mg of α,α'-azobisisobutyronitrile as the polymerization initiator and 5 ml of tetrahydrofuran as the solvent were added to 0.93 g of the so-obtained monomer, and the mixture was dissolved and sufficiently dispersed and was then charged in a polymerization tube. Deaeration was repeated several times and the tube was sealed to obtain an ampoule in which sufficiently high vacuum was maintained. Reaction was carried out for 30 hours in a thermostat tank maintained at 60° C. to obtain 0.79 g of a polymer.

The weight average molecular weight of the polymer was 17,000 and the polymer was soluble in a solvent such as THF or chloroform.

Visible absorption spectra of 3-carboxymethyl-5-(p-diethylaminoenzylidene)rhodanine and polystyrene having this rhodanine derivative supported on the side chain (the above-mentioned polymer) are shown in FIG. 1. As is apparent from FIG. 1, the maximum absorption wavelength of the polystyrene having 3-carboxymethyl-5-(p-diethylaminobenzylidene)rhodanine was 473 nm and was in the visible ray region.

The so-obtained polymer will be referred to as "polymer (1-a)" hereinafter.

(b) Second Synthesis Process

In 15 ml of DMF were dissolved 0.6 g of chloromethylated polystyrene (having a weight average molecular weight of 25,000) and 0.4 g of 3-carboxymethyl-5-(p-diethylaminobenzylidene)rhodanine, and 1 ml of triethylamine was added to the solution and reaction was carried out at 90° C.

After 2 hours, the reaction solution was added to a 1/1 mixed solution of water and methanol with stirring. The formed precipitate was washed with a 1/1 mixed solution of water and methanol, re-precipitated from THF/hexane and dried under reduced pressure. The so-obtained charge-generating material having an N-substituted-5-(p-diethylaminobenzylidene)rhodanine supported on the side chain of polystyrene was soluble in a solvent such as THF or chloroform.

From the results of the elementary analysis, it was found that the rhodanine derivative content of the polymer was about 50% by weight.

The so-obtained polymer will be referred to as "polymer (1-b)".

EXAMPLE 1

(Single-Layer Photosensitive Material)

In 100 parts by weight of THF were dissolved 7 parts by weight of the polymer (1-a) and 3 parts by weight of N,N-diethylaminobenzaldehydo-N,N-diphenylhydrazone, and the solution was coated on an aluminum sheet by using a doctor blade and the coated aluminum sheet was dried at 100° C. for 30 minutes to obtain an electrophotographic photosensitive material having a thickness of 20 μm.

(Laminate Photosensitive Material)

A charge-generating layer-forming coating liquid comprising the polymer (1-a) and a predetermined amount of tetrahydrofuran was prepared, and the coating liquid was coated on an aluminum sheet and the coated sheet was heated at a temperature of 100° C. for 30 minutes to form a charge-generating layer having a thickness of about 0.5 μm.

Then, 7 parts by weight of N,N-diethylaminobenzaldehydo-N,N-diphenylhydrazone and 10 parts by weight a bisphenol Z type polycarbonate resin (PCZ supplied by Mitsubishi Gas Chemical) were incorporated and dissolved in 80 parts by weight of benzene to form a coating liquid for formation of a charge-transporting layer, and the coating liquid was coated on the charge-generating layer and was then heated and dried to form a charge-transporting layer having a thickness of 20 μm, whereby a negative charging type laminate photosensitive material for the electrophotography, having a laminate type photosensitive layer, was formed. When the charge-transporting layer and charge-generating layer were formed by reversing the coating order, a positive charging type laminate photosensitive material was obtained.

(Evaluation of Electrophotographic Photosensitive Material)

In order to examine the charging characteristics and photosensitivity characteristics of the above-mentioned electrophotographic photosensitive materials, using an electrostatic copy paper tester (Model SP-28 supplied by Kawaguchi Denki), corona discharge was carried out by applying +6.0KV in case of the photosensitive material having the laminate type photosensitive layer having the charge-transporting layer on the side of the aluminum substrate, −6.0KV in case of the photosensitive material having the laminate type photosensitive layer having the charge-generating layer on the side of the aluminum substrate or +6.0KV in case of the photosensitive material having the single-layer type photosensitive layer, whereby the above-mentioned electrophotographic photosensitive materials were negatively or positively charged. With respect to each photosensitive material, the initial surface voltage Vsp was measured, and by using a 10-lux tungsten lamp, the surface of the photosensitive material was light-exposed, and the time required for reducing the above-mentioned surface voltage Vsp to ½ was measured and the half-value exposure quantity $E_{\frac{1}{2}}$ (lux.sec) was calculated.

The results of the measurement of the charging characteristics and photosensitivity characteristics of the respective photosensitive materials are shown in Table 1.

TABLE 1

| Photosensitive Material | Vsp (V) | $E_{\frac{1}{2}}$ (lux · sec) |
|---|---|---|
| single layer | +750 | 4.6 |
| positive charging type laminate | +740 | 4.0 |
| negative charging type laminate | −790 | 3.8 |

The respective photosensitive materials showed sensitivity and charging characteristics comparable or superior to those of conventional photosensitive materials formed by using an azo pigment as the charge-generating substance and a hydrazone compound as the charge-transporting substance.

Especially, the laminate photosensitive material comprising the charge-generating material of the present invention in the surface layer was excellent in the smoothness and abrasion resistance of the surface because the photosensitive material was not of the pigment dispersion type but of the resin type.

EXAMPLE 2

(Single-Layer Type Photosensitive Layer)

A coating liquid for formation of a single-layer type photosensitive layer, comprising 100 parts by weight of the polymer (1-b), 70 parts by weight of N,N-diethyleneaminobenzaldehydo-N,N-diphenylhydrazone and a predetermined amount of tetrahydrofuran, was prepared, and this coating liquid was coated on an aluminum sheet and the coated sheet was heated at a temperature of 100° C. for 30 minutes to obtain an electrophotographic photosensitive material having a single-layer type photosensitive layer having a thickness of about 25 μm.

(Laminate Photosensitive Material)

A coating liquid for formation of a charge-generating layer, comprising the polymer (1-b) and a predetermined amount of tetrahydrofuran, was prepared and coated on an aluminum sheet, and the coated sheet was heated at a temperature of 100° C. for 30 minutes to form a charge-generating layer having a thickness of about 0.5 μm.

A coating liquid for formation of a charge-transporting layer was prepared by incorporating and dissolving 7 parts by weight of N,N-diethylaminobenzaldehydo- N,N-diphenylhydrazone and 10 parts by weight of a bisphenol Z type polycarbonate (PCZ supplied by Mitsubishi Gas Chemical) in a predetermined amount of benzene and was coated on the charge-generating layer, followed by heating and drying, to form a charge-transporting layer having a thickness of about 25 μum, whereby an electrophotographic photosensitive having a laminate photosensitive layer was prepared.

A photosensitive material was similarly prepared by reversing the order of the coating operations for formation of the charge-transporting layer and charge-generating layer.

(Evaluation of Photosensitive Materials)

The so-obtained photosensitive materials for the electrophotography were positively or negatively charged in the same manner as described in Example 1.

The initial surface voltage Vsp of each photosensitive material was measured, and by using a 10-lux tungsten lamp, the surface of the photosensitive material was light-exposed, the time required for reducing the surface voltage Vsp to ½ was measured and the half-value light exposure quantity $E_{\frac{1}{2}}$ (lux.sec) was calculated. Furthermore, after the light exposure, the surface voltage after the passage of 0.15 second was measured as the residual voltage Vrp (V).

Each photosensitive material showed sensitivity and charging characteristics comparable or superior to those attainable by conventional photosensitive materials prepared by using an azo type pigment as the charge-generating substance and a hydrazone compound as the charge-transporting substance.

Especially, the laminate photosensitive material comprising the charge-generating material of the present invention in the surface layer was excellent in the smoothness and abrasion resistance of the surface because the photosensitive material was not of the pigment dispersion type but of the resin type.

SYNTHESIS EXAMPLE 2

This example illustrates the synthesis of a polymer having an N-substituted-5-(p-ethylbenzylidene)rhodanine supported on the side chain of polystyrene.

(a) First Synthesis Process

Reaction between 19.1 g of 3-carboxymethylrhodanine and 13.4 g of p-ethylbenzaldehyde was carried out in DMF at 100° C. After 3 hours, water was added to the reaction solution, and the formed precipitate was washed with water and recrystallized from acetone to obtain 3-carboxy-methyl-5-(p-ethylbenzylidene)rhodanine (the yield was 86%).

In 100 ml of dimethylformamide were dissolved 15.2 g of p-chloromethylstyrene, 30.7 g of 3-carboxymethyl-5-(p-ethylbenzylidene)rhodanine and 12 ml of triethylamine, and reaction was carried out at 90° C. for 3 hours.

After the reaction, the reaction solution was poured into water, and the formed precipitate was washed with water and recrystallized from acetone to obtain 3-(p-vinylbenzyl)-5-(p-ethylaminobenzylidene)rhodanine.

To 4.7 g of 3-(p-vinylbenzyl)-5-(p-ethylaminobenzylidene)rhodanine were added 6 mg of α,α'-azobisisobutyronitrile as the polymerization initiator and 5 ml of tetrahydrofuran as the solvent, and the mixture was dissolved and charged in a polymerization tube. Deaeration was repeated several times, and sufficiently high vacuum was produced by the tube-sealing method to obtain an ampoule.

The ampoule was immersed in a thermostat tank maintained at 60° C. for 30 hours to effect reaction and obtain 4.4 g of a charge-generating material of the present invention (hereinafter referred to as "polymer (2-a)").

The weight average molecular weight of the polymer (2-a) was 23,500.

(b) Second Synthesis Process

In 100 ml of dimethylformamide were dissolved 30.7 g of 3-carboxymethyl-5-(p-ethylbenzylidene)rhodanine obtained at the intermediate step of the first synthesis process (a), 15.2 g of polychloromethylstyrene having a weight average molecular weight of 27,500 and 12 ml of triethylamine, and reaction was carried out at 100° C. for 3 hours.

After the reaction, the reaction solution was poured in methanol, and the formed precipitate was washed with water and then with methanol, reprecipitated from THF/methanol and dried under reduced pressure to obtain a charge-generating material having an N-substituted-5-(p-ethylbenzylidene)rhodanine supported on the side chain of polystyrene (hereinafter referred to as "polymer (2-b)").

The rhodanine derivative content of the polymer (2-b) was 41% by weight.

EXAMPLE 3

(Single-Layer Photosensitive Material)

In 100 parts by weight of THF were dissolved 7 parts by weight of the polymer (2-a) and 3 parts weight of N,N-diethylaminobenzaldehydo-N,N-diphenylhydrazone and the solution was coated on an aluminum sheet by using a doctor blade, and the coated sheet was dried at 100° C. for 30 minutes to form an electrophotographic photosensitive material having a thickness of 20 μm.

(Laminate Photosensitive Material)

A charge-generating layer-forming coating liquid comprising the polymer (2-a) and a predetermined amount of tetrahydrofuran was prepared, and the coating liquid was coated on an aluminum sheet and the coated sheet was heated at a temperature of 100° C. for 30 minutes to form a charge-generating layer having a thickness of about 0.5 μm.

Then, 7 parts by weight of N,N-diethylaminobenzaldehydo-N,N-diphenylhydrazone and 10 parts by weight a bisphenol Z type polycarbonate resin (PCZ supplied by Mitsubishi Gas Chemical) were incorporated and dissolved in 80 parts by weight of benzene to form a coating liquid for formation of a charge-transporting layer, and the coating liquid was coated on the charge-generating layer and was then heated and dried to form a charge-transporting layer having a thickness of 20 μm, whereby a negative charging type laminate photosensitive material for the electrophotography, having a laminate type photosensitive layer, was formed.

When the charge-transporting layer and charge-generating layer were formed by reversing the coating order, a positive charging type laminate photosensitive material was obtained.

(Evaluation of Electrophotographic Photosensitive Material)

The charging and photosensitivity characteristics of each photosensitive material were determined in the same manner as described in Example 1.

The measurement results are shown in Table 2.

TABLE 2

| Photosensitive Material | Polymer | Vsp (V) | $E_{\frac{1}{2}}$ (lux · sec) |
|---|---|---|---|
| single layer | (2-a) | +760 | 5.0 |
| positive charging type laminate | (2-a) | +750 | 4.5 |
| negative charging type laminate | (2-a) | −800 | 4.0 |

Each photosensitive material showed sensitivity and charging characteristics comparable or superior to those attainable by conventional photosensitive materials prepared by using an azo type pigment as the charge-generating substance and a hydrazone compound as the charge-transporting substance.

Especially, the laminate photosensitive material comprising the charge-generating material of the present invention in the surface layer was excellent in the smoothness and abrasion resistance of the surface because the photosensitive material was not of the pigment dispersion type but of the resin type.

EXAMPLE 4

Single-layer and laminate photosensitive materials were prepared in the same manner as described in Example 1 except that the polymer (2-b) was used, and the charging and photosensitivity characteristics were determined The measurement results are shown in Table 3.

TABLE 3

| Photosensitive Material | Polymer | Vsp (V) | $E_{\frac{1}{2}}$ (lux · sec) |
|---|---|---|---|
| single layer | (2-b) | +750 | 5.3 |
| positive charging type laminate | (2-b) | +770 | 5.1 |
| negative charging type laminate | (2-b) | −800 | 5.1 |

SYNTHESIS EXAMPLE 3

This example illustrates the synthesis of a polymer having an N-substituted-5-[2-(3-ethylbenzothiazoline)-dimethine]rhodanine bonded to the side chain of polystyrene.

(a) First Synthesis Process

In ethanol, 19.1 g of 3-carboxymethylrhodanine, 45.2 g of 2-β-acetoanilidovinylbenzothiazole ethiodide and 12 ml of triethylamine were refluxed for 30 minutes, and the product was recrystallized from pyridine to obtain 3-carboxymethyl-5-[2-(3-ethylbenzothiazoline)dimethine]-rhodanine (the yield was 45%).

To 100 ml of dimethylformamide and 12 ml of triethylamine were added 15.2 g of p-chloromethylbenzostyrene and 38.0 g of 3-carboxymethyl-5-[2-(3-ethylbenzothiazoline)dimethine]rhodanine, and reaction was carried out at 90° C. for 3 hours.

After the reaction, the reaction liquid was poured into water, and the formed precipitate was washed with water and recrystallized from acetone to obtain 3-(p-vinylbenzyl)-5-[2-(3-ethylbenzothiazoline)dimethine] rhodanine.

To 4.1 g of the obtained monomer were added 6 mg of α,α-azobisisobutyronitrile as the polymerization initiator and 5 ml of tetrahydrofuran as the solvent, and the mixture was dissolved and charged in a polymerization tube. Deaearation was repeated and sufficiently high vacuum was produced by the tube-sealing method to form an ampoule.

The ampoule was immersed in a thermostat tank maintained at 60° C. for 30 hours to obtain 3.8 g of a polymer of the present invention (hereinafter referred to as "polymer (3-a)").

The weight average molecular weight of the polymer (3-a) was 18,000.

(b) Second Synthesis Process

In 100 ml of dimethylformamide were dissolved 38.0 g of 3-carboxymethyl-5-2-(3-ethylbenzothiazoline)-dimethine]rhodanine obtained at the intermediate step of the first synthesis process (a), 15.2 g of polychloromethylstyrene having a weight average molecular weight of 27,500 and 12 ml of triethylamine, and reaction was carried out at 100° C. for 3 hours. After the reaction, the reaction solution was poured into methanol, and the formed precipitate was washed with water and then with methanol, reprecipitated from THF/methanol and dried under reduced pressure to obtain a polymer having an N-substituted-5-[2-(3-ethylbenzothiazoline)dimethine]rhodanine supported on the side chain of polystyrene (hereinafter referred to as "polymer (3-b)").

The rhodanine derivative content in the so-obtained polymer (3-b) was about 38% by weight.

EXAMPLE 5

Single-layer and laminate photosensitive materials were prepared in the same manner as described in Example 1 by using the polymers (3-a) and (3-b), and the charging and photosensitivity characteristics of the photosensitive materials were determined in the same manner as described in Example 1.

The obtained results are shown in Table 4.

TABLE 4

| Photosensitive Material | Polymer | Vsp (V) | $E_{\frac{1}{2}}$ (lux · sec) |
|---|---|---|---|
| single-layer | (3-a) | +730 | 6.7 |
| " | (3-b) | +740 | 6.6 |
| positive charging type laminate | (3-a) | +740 | 6.3 |
| positive charging type laminate | (3-b) | +720 | 5.9 |
| negative charging type laminate | (3-a) | −820 | 6.1 |
| negative charging type laminate | (3-b) | −810 | 5.8 |

The respective photosensitive materials showed sensitivity and charging characteristics comparable or superior to those of conventional photosensitive materials formed by using an azo pigment as the charge-generating substance and a hydrazone compound as the charge-transporting substance.

Especially, the laminate photosensitive material comprising the charge-generating material of the present invention in the surface layer was excellent in the smoothness and abrasion resistance of the surface because the photosensitive material was not of the pigment dispersion type but of the resin type.

SYNTHESIS EXAMPLE 4

This example illustrates the synthesis of a polymer having an N-substituted-5-[2-(1-ethylquinoline)dimethine]rhodanine supported on the side chain of polystyrene.

(a) First Synthesis Process

In ethanol, 19.1 g of 3-carboxymethylrhodanine, 44.4 g of 2-β-acetoanilidovinylquinoline ethiodide and 12 ml of triethylamine were refluxed for 30 minutes, and the formed product was recrystallized from pyridine to obtain 3-carboxymethyl-5-[2-(3-ethylquinoline)dimethine]rhodanine (the yield was 62%).

In 100 ml of dimethylformamide were dissolved 15.2 g of p-chloromethylstyrene, 37.2 g of 3-carboxymethyl-5-[2-(3-ethylquinoline)dimethine rhodanine and 12 ml of triethylamine, and reaction was carried out at 90° C. for 3 hours. After the reaction, the reaction solution was poured into water, and the formed precipitate was washed with water and recrystallized from acetone to obtain a monomer having the rhodanine derivative bonded thereto.

To 4.3 g of the so-obtained monomer, that is, 3-(p-vinylbenzyl)-5-2-(3-ethylquinoline)dimethine]rhodanine, were added 6 mg of α,α'-azobisisobutyronitrile as the polymerization initiator and 5 ml of tetrahydrofuran as the solvent, and the mixture was dissolved and charged in a polymerization tube. Deaeration was repeated several times and sufficiently high vacuum was produced according to the tube-sealing method to obtain an ampoule.

The ampoule was immersed in a thermostat tank maintained at 60° C. for 30 hours to obtain 4.0 g of a chargegenerating material of the present invention (hereinafter referred to as "polymer (4-a)").

The weight average molecular weight of the polymer (4-a) was 19,000.

(b) Second Synthesis Process

In 100 ml of dimethylformamide were dissolved 37.2 g of 3-carboxymethyl-5-[2-(3-ethylquinoline)dimethine]rhodanine obtained at the intermediate step of the first synthesis process, 15.2 g of poly-p-chloromethylstyrene having a weight average molecular weight of 27,500 and 12 ml of triethylamine, and reaction was carried out at 100° C. for 3 hours. After the reaction, the reaction solution was poured into methanol, and the formed precipitate was washed with water and then with methanol, reprecipitated from THF/methanol and dried under reduced pressure to obtain a polymer having an N-substituted-5-2-(ethylquinoline)dimethine]rhodanine supported on the side chain of polystyrene (hereinafter referred to as "polymer (4-b)").

The rhodanine derivative content in the so-obtained polymer (4-b) was about 43% by weight.

EXAMPLE 6

Single-layer and laminate photosensitive materials were prepared in the same manner as described in Example 1 by using the polymers (4-a) and (4-b), and the charging and photosensitivity characteristics of the photosensitive materials were determined in the same manner as described in Example 1.

The obtained results are shown in Table 5.

TABLE 5

| Photosensitive Material | Polymer | Vsp (V) | $E_{\frac{1}{2}}$ (lux · sec) |
|---|---|---|---|
| single-layer | (4-a) | +720 | 4.8 |
| " | (4-b) | +730 | 6.7 |
| positive charging type laminate | (4-a) | +700 | 4.5 |
| positive charging type laminate | (4-b) | +720 | 4.8 |
| negative charging type laminate | (4-a) | −780 | 4.2 |
| negative charging type laminate | (4-b) | −790 | 4.7 |

TABLE 5-continued

SYNTHESIS EXAMPLE 5

This example illustrates the synthesis of a polymer having an N-substituted-5-[4-(1-ethylquinoline)dimethine]rhodanine supported on the side chain of polystyrene.

(a) First Synthesis Process

In ethanol, 19.1 g of 3-carboxymethylrhodanine, 44.4 g of4-β-acetoanidovinylquinoline ethiodide and 12 ml of triethylamine were refluxed for 30 minutes, and the product was recrystallized from pyridine to obtain 3-carboxymethyl-5-[4-(1-ethylquinoline)dimethine]rhodanine (the yield was 45%).

In 100 ml of dimethylformamide were dissolved 15.2 g of chloromethylstyrene, 37.2 g of 3-carboxymethyl-5-[4-(1-ethylquinoline)dimethine]rhodanine and 12 ml of triethylamine, and reaction was carried out at 100° C. for 3 hours.

After the reaction, the reaction solution was poured into water, and the formed precipitate was washed with water and recrystallized from acetone to obtain a monomer having an N-substituted-5-[4-(1-ethylquinoline)-dimethine]rhodanine supported on the side chain of styrene.

To 4.3 g of the so-obtained monomer were added 6 mg of α,α'-azobisisobutyronitrile as the polymerization initiator and 5 ml of tetrahydrofuran as the solvent, and the mixture was dissolved and charged in a polymerization tube. Deaeration was repeated several times and sufficiently high vacuum was produced by the tube-sealing method to obtain an ampoule.

The ampoule was immersed in a thermostat tank maintained at 60° C. for 30 hours to effect reaction and obtain 4.1 g of a charge-generating material of the present invention (hereinafter referred to as "polymer (5-a)").

The weight average molecular weight of the polymer (5-a) was 21,000.

(b) Second Synthesis Process

In 100 ml of dimethylformamide were dissolved 37.2 g of 3-carboxymethyl-5-[4-(1-ethylquinoline)dimethine]rhodanine obtained at the intermediate step of the first synthesis process, 15.2 g of polychloromethylstyrene having a weight average molecular weight of 27,500 and 12 ml of triethylamine, and reaction was carried out at 100° C. for 3 hours. After the reaction, the reaction solution was poured into methanol, and the formed precipitate was washed with water and then with methanol, re-precipitated from THF/methanol and dried under reduced pressure to obtain a charge-generating polymer having an N-substituted-5-[4-(1-ethylquinoline)dimethine]rhodanine supported on the side chain of polystyrene (hereinafter referred to as "polymer (5-b)").

The rhodanine derivative content in the so-obtained polymer (5-b) was about 35% by weight.

EXAMPLE 7

Single-layer and laminate photosensitive materials were prepared in the same manner as described in Example 1 by using the polymers (5-a) and (5-b), and the charging and photosensitivity characteristics of the photosensitive materials were determined in the same manner as described in Example 1.

The obtained results are shown in Table 6.

TABLE 6

| Photosensitive Material | Polymer | Vsp (V) | $E_{\frac{1}{2}}$ (lux · sec) |
|---|---|---|---|
| single-layer | (5-a) | +650 | 5.4 |
| " | (5-b) | +690 | 5.6 |
| positive charging type laminate | (5-a) | +730 | 4.9 |
| positive charging type laminate | (5-b) | +760 | 5.2 |
| negative charging type laminate | (5-a) | −810 | 4.7 |
| negative charging type laminate | (5-b) | −820 | 5.2 |

EXAMPLE 8

A solution comprising 100 parts by weight of a styrene/acrylic copolymer as the binder resin, 100 parts by weight of the polymer (1-a) obtained in Synthesis Example 1 and a solvent comprising 2500 parts by weight of toluene and 500 parts by weight of THF was sufficiently mixed and dispersed, and a photoconductive toner having a median particle size of 11 μm was formed by the spray-dry method. The obtained toner had a photosensitivity to a blue light having a wavelength in the vicinity of 480 nm. Then, the so-obtained toner was mixed with an electrophotographic carrier (ferrite carrier having an average particle size of 80 μm) to negatively charge the toner (the toner concentration was 8%). When the so-formed developer was applied to an aluminum substrate and an image was formed by blue light, an image having a sharp orange color with no slit in a letter portion was obtained without background fogging.

EXAMPLE 9

A solution comprising 100 parts by weight of the polymer (1-b) obtained in Synthesis Example 1, 40 parts by weight of 4-diethylaminobenzaldehydo-1,2-diphenylhydrazone as the charge-transporting material and a solvent comprising 2,500 parts by weight of toluene and 500 parts by weight of THF was sufficiently mixed and dispersed, and a photoconductive toner having a median particle size of 10 μm was obtained by the spray-dry method. The toner had a photosensitivity to blue light in the vicinity of 480 nm. The so-obtained toner was mixed with an electrophotographic carrier (ferrite carrier having an average particle size of 80 μm) to negatively charge the toner (the toner concentration was 8%). When the so-formed developer was applied to an aluminum substrate and an image was formed by using blue light, an image having a sharp orange color with no slip in a letter portion was obtained without background fogging.

We claim:

1. A charge-generating material for electrophotography, which comprises a linear high-molecular-weight polymer substituted with a rhodanine derivative having the following structural formula

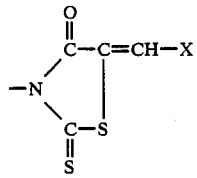

wherein X is a substituent selected from the group consisting of (i)

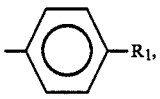

(ii)

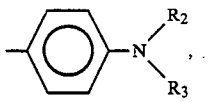

(iii)

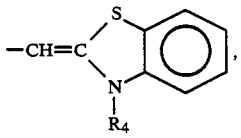

(iv)

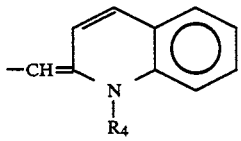

and (v)

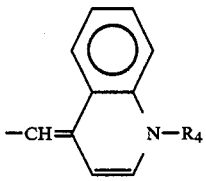

in which $R_1$ stands for a lower alkyl group having up to 6 carbon atoms or a hydroxyl group, $R_2$ and $R_3$ stand for a hydrogen atom, a substituted or unsubstituted aryl group or a hydroxyl group, and $R_4$ stands for a hydrogen atom, a lower alkyl group having up to 6 carbon atoms, a substituted or unsubstituted aryl group or a hydroxyl group, said rhodanine derivative group being present in an amount of 20 to 50% by weight based on the polymer, and said polymer having a weight average molecular weight of about 15,000 to 200,000.

2. The charge-generating material as set forth in claim 1, wherein said linear high-molecular-weight polymer is obtained by polymerizing a monomer substituted with said rhodanine derivative group.

3. The charge-generating material as set forth in claim 1, wherein said linear high-molecular-weight polymer is obtained by reacting a polymer having reactive groups with a compound reactive with said reactive groups, said compound substituted with said rhodanine derivative group.

4. A photoconductive material comprising said charge-generating material as set forth in claim 1 and a chargetransporting material.

5. The photoconductive material as set forth in claim 4, wherein said charge-transporting material is present in an amount of 20 to 100% by weight based on said linear high-molecular-weight polymer substituted with said rhodanine derivative.

6. The photoconductive material as set forth in claim 4, in the form of a photoconductive toner, wherein said charge-transporting material is present in an amount of 20 to 50% by weight based on said linear high-molecular-weight polymer substituted with said rhodanine derivative.

7. The photoconductive material as set forth in claim 6, wherein said linear high-molecular-weight polymer has a softening point of 50° to 200° C.

8. A photosensitive material comprising said photoconductive material as set forth in claim 4 coated on an electroconductive substrate.

9. The photosensitive material as set forth in claim 8, wherein said photosensitive material is a single-layer photosensitive material and said photoconductive material is prepared by incorporating said charge-transporting material into said change-generating material.

10. The photosensitive material as set forth in claim 9, wherein said charge-transporting material is present in an amount of 20 to 100% by weight based on said linear high-molecular-weight polymer substituted with said rhodanine derivative.

11. The photosensitive material as set forth in claim 8, wherein said photosensitive material is a laminate photosensitive material and said photoconductive material comprises a first layer comprising said charge-generating material and a second layer comprising said charge-transporting material.

12. The photosensitive material as set forth in claim 11, wherein said second layer comprises said charge-transporting material incorporated in a binder resin having a film-forming property, said charge-transporting material being present in an amount of 30 to 150% by weight based on said binder resin.

13. A photoconductive material for the electrophotography, which comprises a linear high-molecular-weight polymer comprising recurring units represented by the following formula

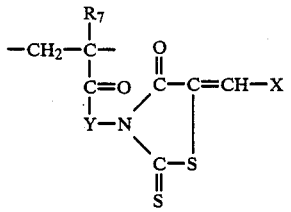

wherein $R_7$ represents a hydrogen atom or a methyl group, Y is a divalent group selected from the group consisting of —NH—, —$OCH_2$—, —$NHCOCH_2$— and

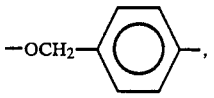

and X is a substituent selected from the group consisting of

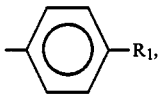

(i)

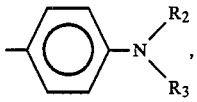

(ii)

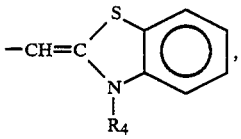

(iii)

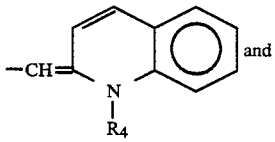

and (iv)

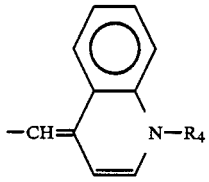

(v)

in which $R_1$ stands for a lower alkyl group having up to 6 carbon atoms or a hydroxyl group, $R_2$ and $R_3$ stand for a hydrogen atom, a substituted or unsubstituted aryl group or a hydroxyl group, and $R_4$ stands for a hydrogen atom, a lower alkyl group having up to 6 carbon atoms, a substituted or unsubstituted aryl group or a hydroxyl group; and a charge-transporting material.

14. A photoconductive material for the electrophotography, which comprises a linear high-molecular-weight polymer comprising recurring units represented by the following formula

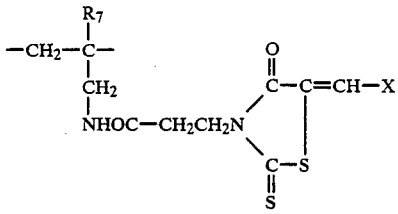

wherein $R_7$ represents a hydrogen atom or a methyl group, and X is a substituent selected from the group consisting of

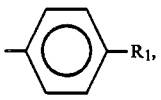

(i)

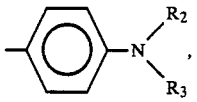

(ii)

-continued (iii)

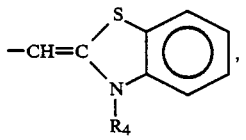

(iv)

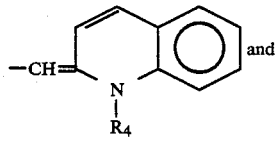

and (v)

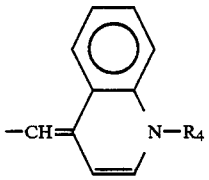

in which $R_1$ stands for a lower alkyl group having up to 6 carbon atoms or a hydroxyl group, $R_2$ and $R_3$ stand for a hydrogen atom, a substituted or unsubstituted aryl group or a hydroxyl group, and $R_4$ stands for a hydrogen atom, a lower alkyl group having up to 6 carbon atoms, a substituted or unsubstituted aryl group or a hydroxyl group and a charge-transporting material.

15. A photoconductive material for electrophotography, which comprises a linear high-molecular-weight polymer comprising recurring units represented by the following formula:

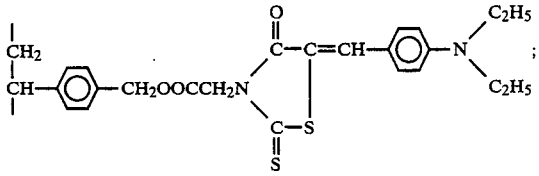

and a charge-transporting material.

16. A charge-generating material for electrophotography, which comprises a linear high-molecular-weight polymer substituted with a rhodanine derivative having the following structural formula:

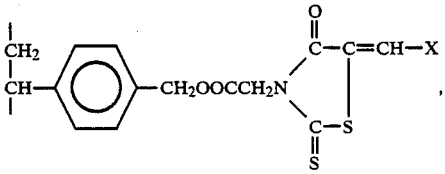

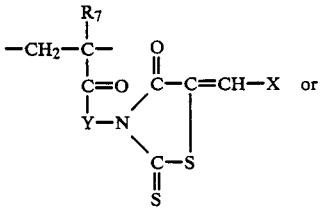

or

-continued

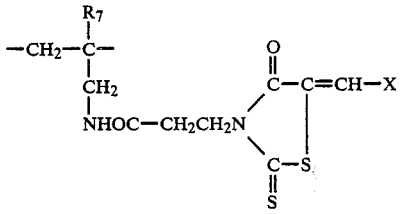

wherein X is a substituent selected from the group consisting of (i)

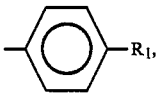

(ii)

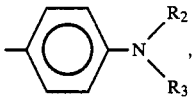

(iii)

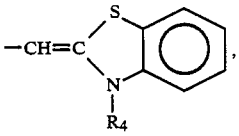

(iv)

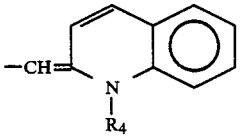

and (v)

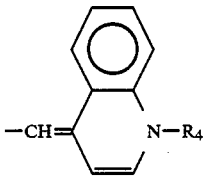

in which $R_1$ stands for a lower alkyl group having up to 6 carbon atoms or a hydroxyl group, $R_2$ and $R_3$ stand for a hydrogen atom, a substituted or unsubstituted aryl group or a hydroxyl group, and $R_4$ stands for a hydrogen atom, a lower alkyl group having up to 6 carbon atoms, a substituted or unsubstituted aryl group or a hydroxyl group, $R_7$ represents a hydrogen atom or a methyl group, and Y is a divalent group selected from the group consisting of —NH—, —$CH_2$—, —$NHCOCH_2$— and

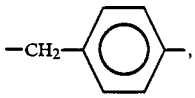

said rhodanine derivative group being present in an amount of 20 to 50% by weight based on the polymer, and said polymer having a weight average molecular weight of about 15,000 to about 200,000.

* * * * *